US007178297B2

(12) United States Patent
Seavy

(10) Patent No.: US 7,178,297 B2
(45) Date of Patent: Feb. 20, 2007

(54) STRUCTURES INCORPORATING INTERLOCKING WALL MODULES

(76) Inventor: Richard J Seavy, 180 Air Park Dr., Wilsonville, AL (US) 35186

( * ) Notice: Subject to any disclaimer, the term of this patent is extended or adjusted under 35 U.S.C. 154(b) by 0 days.

(21) Appl. No.: 10/174,421

(22) Filed: Jun. 18, 2002

(65) Prior Publication Data

US 2003/0230038 A1 Dec. 18, 2003

(51) Int. Cl.
*E04B 2/00* (2006.01)

(52) U.S. Cl. ..... 52/271; 52/284; 52/79.5; 52/509; 52/582.2; 52/581; 52/588.1

(58) Field of Classification Search ..... 52/271, 52/79.9, 582.2, 284, 79.1, 106, 288.1, 588, 52/511.1, 589.1, 592.1, 79.5, 141, 506.09, 52/506.06, 509, 510, 582.1, 581, 588.1
See application file for complete search history.

(56) References Cited

U.S. PATENT DOCUMENTS 2,054,665 A * 9/1936 Tracy ..... 52/461
2,129,441 A * 9/1938 Otto ..... 52/91.1
2,328,928 A * 9/1943 Sherron ..... 52/27.5
2,362,162 A * 11/1944 Sheldon ..... 52/274
2,391,960 A * 1/1946 Gede, Jr. ..... 52/213
2,521,381 A * 9/1950 Linck ..... 52/262
2,568,133 A * 9/1951 Swisher, Sr. et al. ..... 52/275
2,702,412 A * 2/1955 Asch ..... 52/275
2,819,491 A * 1/1958 Gammill et al. ..... 264/123
3,236,014 A * 2/1966 Edgar ..... 52/270
3,303,620 A 2/1967 Dawson et al.
3,562,992 A * 2/1971 Kinsey ..... 52/588.1
3,608,260 A * 9/1971 Eckle et al. ..... 52/284
3,698,147 A * 10/1972 Sikes ..... 52/276
3,738,083 A * 6/1973 Shimano ..... 52/584.1
3,783,563 A * 1/1974 Moore ..... 52/11
3,789,567 A * 2/1974 Rae et al. ..... 52/584.1
3,807,113 A * 4/1974 Turner ..... 52/314
4,100,711 A * 7/1978 Skuran ..... 52/489.2
4,145,856 A * 3/1979 Wise ..... 52/285.2
4,231,197 A * 11/1980 Caplan et al. ..... 52/36.6
4,402,384 A * 9/1983 Smith et al. ..... 181/210
4,599,829 A * 7/1986 DiMartino, Sr. ..... 52/79.7
4,628,650 A * 12/1986 Parker ..... 52/265
4,689,930 A * 9/1987 Menchetti ..... 52/277
4,754,584 A * 7/1988 Newton, II ..... 52/106
4,788,802 A * 12/1988 Wokas ..... 52/79.1
4,833,841 A * 5/1989 Ellington, III ..... 52/79.1
4,892,052 A * 1/1990 Zook et al. ..... 114/85
4,970,834 A * 11/1990 Polson ..... 52/106
4,989,386 A * 2/1991 Collis ..... 52/584.1
5,026,211 A * 6/1991 Schellenberg et al. ..... 405/204

(Continued)

*Primary Examiner*—Jeanette Chapman

(57) ABSTRACT

Modular structures constructed from interlocking wall modules made of plate steel and assembled with C-channel connectors, including tongue and groove elements used to position adjoining modules adjacent to one another, for example during the construction of a cell block. The tongue and groove elements ensure all adjacent prison cell modules are properly aligned such that the front fascia of each cell module lies within substantially the same plane. Further, the interlocking of the tongue and groove allows for the quick, cost-effective construction of a schoolroom having double skinned walls in an effort to increase the stability of the structure. Lastly, the interlocking panels may be formed in relatively small sections and then joined together in order to form a larger wall.

7 Claims, 18 Drawing Sheets

U.S. PATENT DOCUMENTS 5,050,362 A * 9/1991 Tal et al. ..... 52/588.1
5,178,581 A * 1/1993 Del Monte ..... 454/239
5,204,149 A * 4/1993 Phenicie et al. ..... 428/57
5,210,984 A * 5/1993 Eckel ..... 52/79.5
5,257,440 A * 11/1993 Bardou et al. ..... 24/287
5,261,197 A * 11/1993 Pickle, Sr. ..... 52/106
5,313,751 A * 5/1994 Wittler ..... 52/238.1
5,353,557 A * 10/1994 Lerner et al. ..... 52/106
5,402,608 A * 4/1995 Chu ..... 52/79.1
5,411,782 A * 5/1995 Jarvis et al. ..... 428/57
5,528,871 A * 6/1996 Brodeur ..... 52/271
5,631,123 A * 5/1997 Abe ..... 430/506
5,643,488 A * 7/1997 Lee ..... 249/34
5,706,614 A * 1/1998 Wiley et al. ..... 52/79.1
5,737,895 A * 4/1998 Perrin ..... 52/745.1
5,758,467 A * 6/1998 Snear et al. ..... 52/592.1
5,761,854 A * 6/1998 Johnson et al. ..... 52/69
5,811,035 A * 9/1998 Mockry ..... 261/111
5,822,936 A * 10/1998 Bateman ..... 52/281
6,195,950 B1 * 3/2001 Harris ..... 52/270
6,199,340 B1 * 3/2001 Davis ..... 52/592.1
6,253,530 B1 * 7/2001 Price et al. ..... 52/793.1
6,324,796 B1 * 12/2001 Heath ..... 52/177
6,360,494 B1 * 3/2002 Emerson ..... 52/106
6,739,106 B2 * 5/2004 Curatolo ..... 52/592.1
6,769,835 B2 * 8/2004 Stridsman ..... 404/41
6,823,638 B2 * 11/2004 Stanchfield ..... 52/588.1

* cited by examiner

STRUCTURES INCORPORATING INTERLOCKING WALL MODULES

BACKGROUND OF THE INVENTION

1. Field of the Invention

The present invention relates to the construction of modular structures incorporating interlocking double wall modules constructed from plate steel which are guided and positioned through the use of tongue and groove guide elements.

2. Description of Prior Art

In recent years, there has been a substantial increase in the population housed by our prison system. Prisons have become overcrowded with inmates, with some cells housing more that twice the recommended number of inmates. One reason for this overcrowding relates to the high cost associated with the building of prisons which are adequately secure to house prisoners. The lengthy construction time required to construct secure units also adds cost to unit, thereby also contributing to the overcrowding problem.

In an effort to reduce construction costs and times, prefabricated prison cells have been developed. These prefabricated prison cells are modular in design, meaning, each cell comprises an individual, separate unit with the components of each cell being manufactured at a facility distant from the final location of the prison facility. Upon arrival at the final location, the individual components may then be assembled, forming an individual cell unit. These individual cell units are then assembled adjacent to one another creating a cell block. In forming a cell block, the individual cells must be carefully aligned so as to form a cohesive-looking structure. It is the difficulty encountered in properly aligning the individual cells in creating the cell block toward which this invention is directed.

Along these lines, the need occasionally arises in law enforcement to quickly construct temporary structures capable of housing dangerous individuals. These structures are often limited in size and weight due to the fact that they may be constructed within a more permanent structure or setting. For example, many court houses within the United States do not include holding cells or the like, making it difficult to bring dangerous prisoners to trial, as these prisoners must be transported from the local jail to the court house to stand trial. This represents an opportunity in which the dangerous prisoner may either escape or harm a guard during the transport process. Solutions to this problem have included converting a mediation room within the courthouse or something similar, into a temporary lock-up room. However, this presents a further problem, whereby the mediation room is being used for a purpose not intended. Further, employees of the court house may be caught unaware, perhaps due to poor communication, and may not realize that a mediation room previously reserved for that purpose has been transformed into a temporary holding cell. It is toward the construction of panelized prison cells that this invention may also be applied.

In addition to limitations encountered in housing prisoners, recent population expansion has increased the need for one-room classrooms, especially in rural areas. It is desirous that these classrooms be relatively inexpensive and have the capability of being constructed quickly and easily when compared to the traditional brick school houses traditionally employed. Along these lines, the present invention may be modified in order to facilitate the construction of relatively inexpensive school rooms, both sturdy enough to provide adequate protection to our children, and yet easily constructed so as to avoid substantial construction costs.

SUMMARY OF THE INVENTION

It is the object of the present invention to produce modular prison cells, including a tongue and groove connection between adjacent cells for providing a means ensuring the cells are properly aligned with respect to each other during assembly of a cell block.

It is another object of the present invention to provide a lead-in slope on a tongue and groove connection for the purpose of increasing the ease in which the modular prison cells may be aligned, thereby decreasing the time associated with joining individual prison cells together in order to create a cell block.

It is another object of the invention to disclose modular prison cells having sufficient strength in the walls to allow a second story of prison cells to be placed on top of a first story of collected cells, thereby creating a two-story cell block.

It is a further object of this invention to disclose modular classrooms comprised of four walls, including corners employing the tongue and groove connection. The inclusion of a C-channel strengthening member in the classroom walls along with the application of a double wall design further provides strength to the classroom, allowing the classroom to withstand hurricane force winds. Further, the tongue and groove connection employed allows for quick and easy assembly of the classroom, with the wall members being manufactured at a separate facility and transported to the set-up site, and then being assembled together to form a classroom. Further, in the construction of a classroom having a square profile, the side wall members and the rear wall may be interchangeable, all being of a common design and construction, whereby the manufacturing costs may be substantially reduced. Additionally, the front wall of the classroom may also be of the same construction with only the inclusion of a door being necessary to distinguish it from the side walls and rear wall.

It is a further object of the invention to allow for the construction of panelized holding cells comprising walls constructed from a plurality of smaller panels, allowing construction of a holding cell within a permanent structure. In order to facilitate the assembly of the panelized sections into a wall sufficient to house a dangerous criminal, a tongue and groove connection has been included whereby corner pieces, straight wall pieces, and even a T-connection allow for the construction of holding cells adjacent to one another, employ the tongue and groove connection for quick construction. Further, these panelized sections are intended to be of a size allowing easy entrance through a typical doorway in a permanent structure so as to facilitate a quick construction of a panelized holding cell. Also, as these holding cells may be employed to house individuals accused of dangerous crimes, a C-channel connector is included therein in order to provide for a double wall in the holding cell, increasing the strength of the walls themselves and thereby preventing escape by the individual housed therein.

The above identified objects have been identified by providing a modular wall structure defining a plurality of rooms, where each room has a front wall, a rear wall, and a pair of side walls, where some of the walls may be shared between rooms. The wall structure comprises a tongue extending from one of the walls of a first room, a groove extending from an adjoining wall, where the tongue is slidably insertable in the groove whereby insertion of the tongue into the groove orientates the first side wall relative to the adjoining wall.

In the preferred embodiment of the invention, the groove includes an inner groove guide wall, a groove spacer plate, and an outer groove guide wall, with a channel being formed therebetween, the channel has a larger cross-sectional area than the tongue. Preferably, the inner groove guide wall includes an angled guide wall and a straight guide wall being adjacent to the channel, the angled guide wall being a guide as the tongue is being inserted.

The modular wall structure preferably further includes a second groove extending from a second wall of the first room and a second tongue extending from a first side wall of a third room, wherein the second tongue is located within the second groove and the second wall of the first room being parallel to the first side wall of the third room. Preferably, the walls are constructed of steel plate, whereby the plurality of rooms define modular prison cells.

The tongue and groove are alternatively positioned on walls forming a corner, or are positioned on co-linear walls.

In another embodiment of the invention, a modular wall structure is defined by a plurality of wall panels, comprising first and second wall panels each defined by a pair of rigid structural wall plates being held in a fixed and parallel spaced apart manner. A connecting member is defined by a tongue member on one of the wall panels and a groove member on the other the wall panel, where an inner surface of the at least one wall plate from each of the first and second wall panels is an aligning surface for the connector member.

In the preferred embodiment, the connecting member is cooperatively profiled by the first and second wall panels to position at least one wall plate from each of the first and second wall panels in an end-to-end and co-planar relation. An inner surface of both of the wall plates of each of the wall panels are aligning surfaces for the connector member. The tongue member extends from an inner surface of one of the wall plates and the groove member is defined in part by an inner surface of the other wall plate. The tongue member is defined by a first extension plate member fixed to the inner surface of the one wall plate. The groove is defined by a second extension plate member fixed to, and spaced apart from, the inner surface of the other wall plate. The second extension plate member is spaced apart by a spacer having a slightly larger thickness as the first extension plate member forming the tongue.

Preferably, the first and second wall panels further comprise at least one further wall plate fixed to the wall panel, at an orientation which is perpendicular to the wall panels. The first and second wall panels each comprise one further wall plate fixed to the wall panel, at an orientation which is perpendicular to the wall panels, such that when the first and second wall panels are joined by the connector members, the further wall plates of each of the first and second wall panels are positioned in a parallel and adjacently disposed relation to each other.

Also preferably, an inner surface of both of the wall plates of both of the first and second wall panels are aligning surfaces for the connector member. The modular wall structure is defined such that an end of the wall plates of one of the wall panels has a tongue, and an end of both of the wall plates of the other wall panels each have grooves. Tongues and grooves on respective wall plates are staggered such that tongues on the same wall panel are laterally spaced from each other, and grooves on the same wall panel are laterally spaced from each other. A plurality of wall panels can be assembled to define an enclosed room, whereby some of the wall panels are straight wall panels, and some of the wall panels are corner wall panels. One of the wall panels can also be defined as a T-wall panel, whereby a plurality of enclosed rooms can be assembled one against the other. Each wall panel has a tongue member at one end, and a groove member at the opposite end, such that wall panels can be assembled in an end-to-end relation.

Wall plates of one of the wall panels are angled adjacent to an end, to define the tongues, and the other of the wall panels has the groove member cooperatively profiled to position the first and second wall panels in an angled corner relation. The groove member is defined by positioning a plate extension, adjacent to and spaced apart from, an inner surface of an outer wall plate of the other wall panel. The groove member is defined by a spacer between the wall plate and the plate extension, the spacer having a slightly greater thickness as that of the tongue, and the spacer being positioned to define the depth of the groove, whereby the groove receives the tongue therein.

Preferably, the wall plates of the first and second wall panels are sheet steel panels, and are spaced apart by structural channel members. The wall panel can be a straight member, with the wall plates in parallel planes; a corner member, with the wall plates being formed with a perpendicular bend, with one wall plate being positioned inside the other; or a T-shaped member with three pairs of wall panel plates arranged in a T-configuration.

Further scope of applicability of the present invention will become apparent from the detailed description given hereafter. However, it should be understood that the detailed description and specific examples disclosed herein, while indicating preferred embodiments of the invention, are given by way of illustration only, as various changes and modifications within the spirit and scope of the invention will become apparent to those skilled in the art, from the following detailed description.

BRIEF DESCRIPTION OF THE DRAWINGS

These and other features of the invention will become more apparent and the present invention will be better understood upon consideration of the following description and the accompany drawings, wherein.

DETAILED DESCRIPTION OF THE EMBODIMENTS OF THE INVENTION

The embodiments of the invention described herein are not intended to be exhaustive nor to limit the invention to the precise forms disclosed. Rather, the embodiments selected for description have been selected to enable one skilled in the art to practice this invention.

Figure 1A:
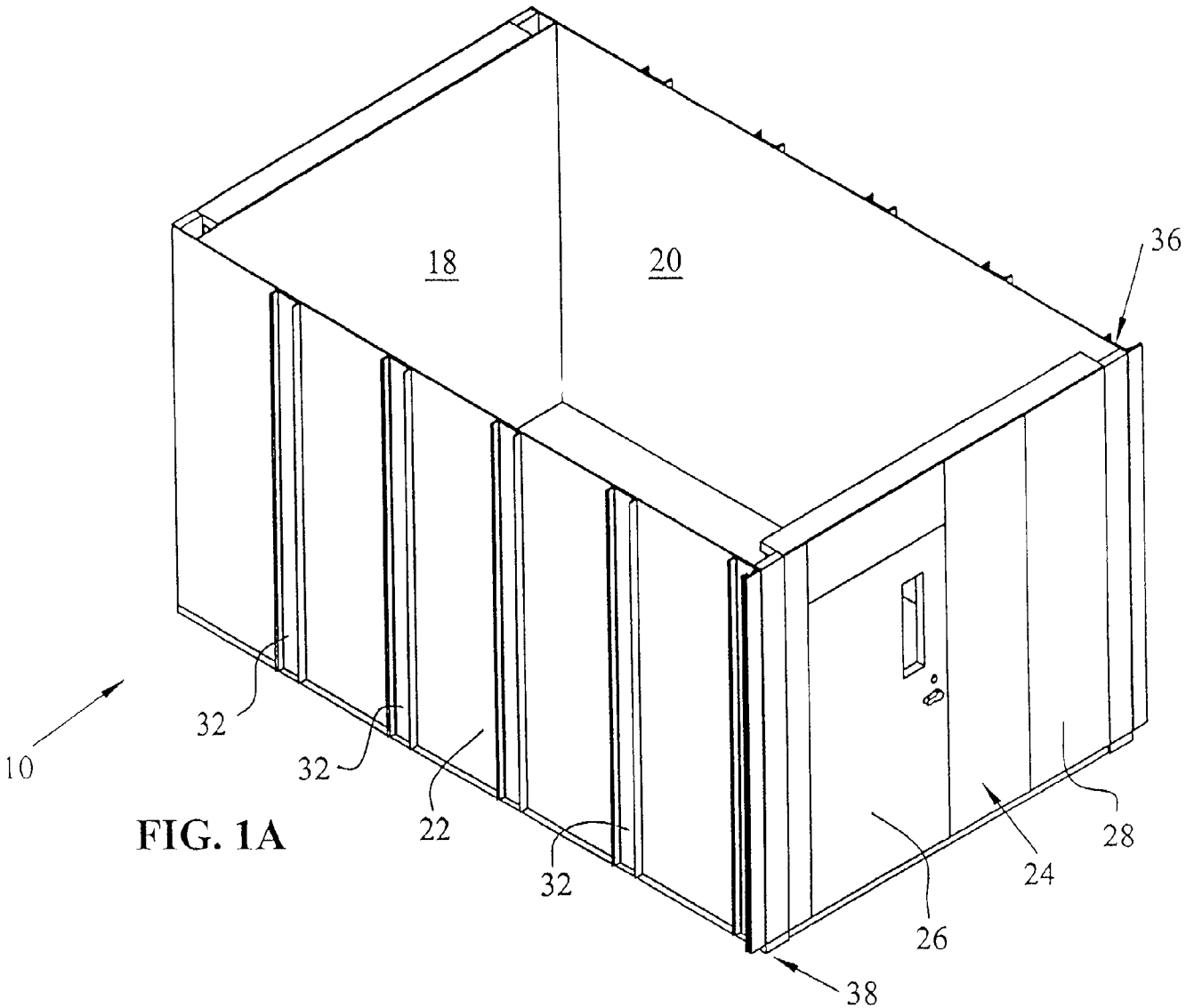
FIG. 1A is a perspective view of a single modular prison cell construction in accordance with the disclosed invention.

Referring in detail to the drawings and with particular reference to FIG. 1A, a modular prison cell has been generally indicated by numeral 10. Certain basic amenities are afforded to a prisoner, such as plumbing for a shower 12, plumbing for a toilet 14, and a bed 16. Modular prison cell 10 includes a rear wall 18, a left side wall 22, a right side wall 20 and a front wall generally indicated by the numeral 24. Generally, left side wall 22 and right side wall 20 are manufactured from a plate steel or a similar material with comparable strength. In this embodiment, modular prison cell 10 is substantially rectangular in shape with left side wall 22 and right side wall 20 being of the same length and rear wall 18, front wall 24 being of the same length. The length of the side walls 20, 22, however, differs from the length associated with the rear wall 18 and the front wall 24. As should be readily apparent to one possessing ordinary skill in the art, all four walls may be manufactured with identical lengths, thereby constructing a modular prison cell having the profile of a square. The four walls 18, 20, 22, 24 should all have substantially equivalent height, with the overall measurements (i.e., height, length, and width) of the left side wall 20 and the right side wall 22 being virtually identical. In addition, the rear wall 18 may be formed from a plate steel similar to that comprising the side walls 20, 22, thereby providing the rear wall 18 with a width substantially identical to that of the side walls 20, 22.

Figure 2:
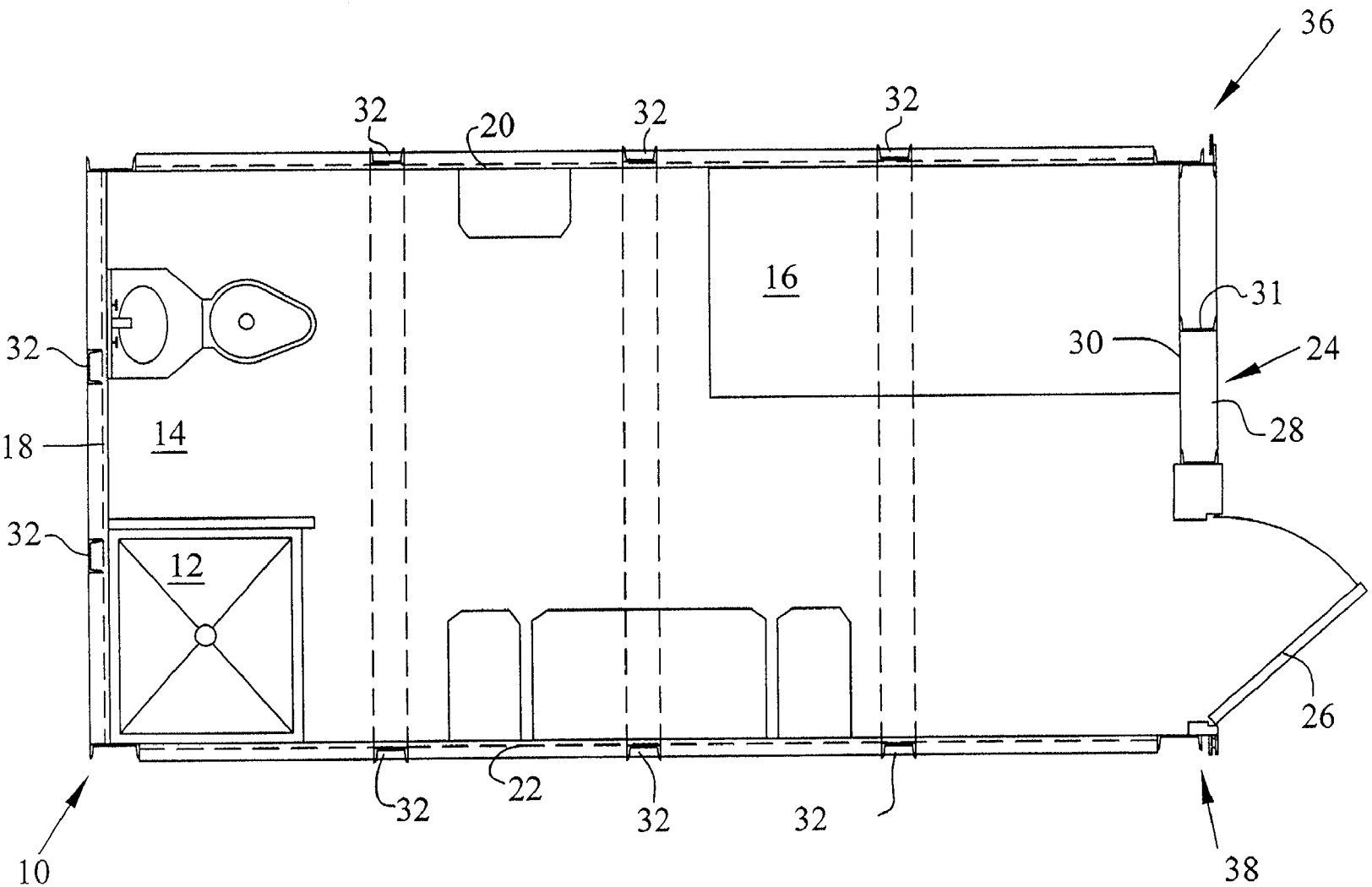
FIG. 2 is a top floor plan view of the modular prison cell disclosed in FIG. 1.
Figure 3:
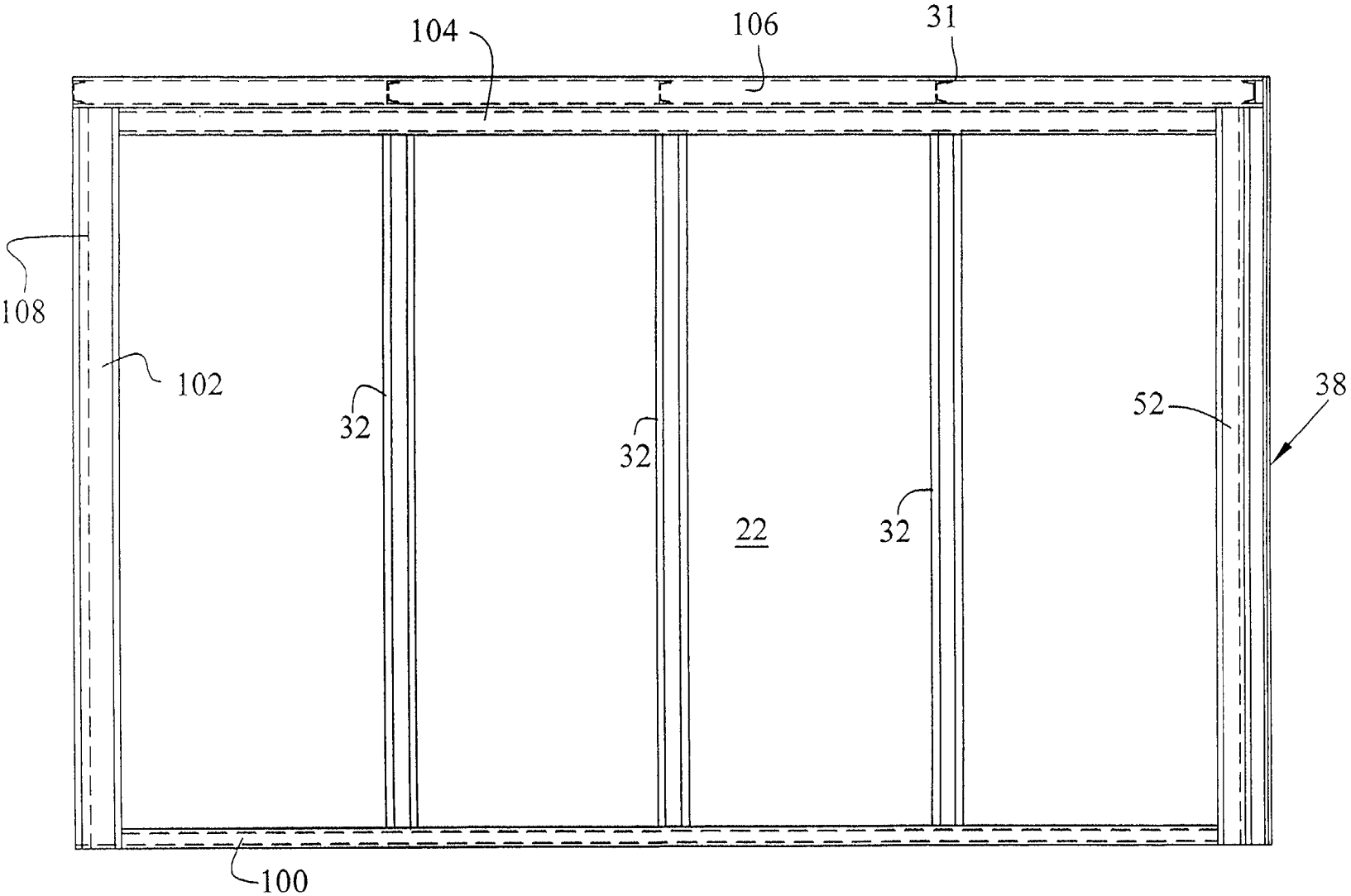
FIG. 3 is left side elevation view showing the left side wall of the modular prison cell shown in FIG. 1.
Figure 4:
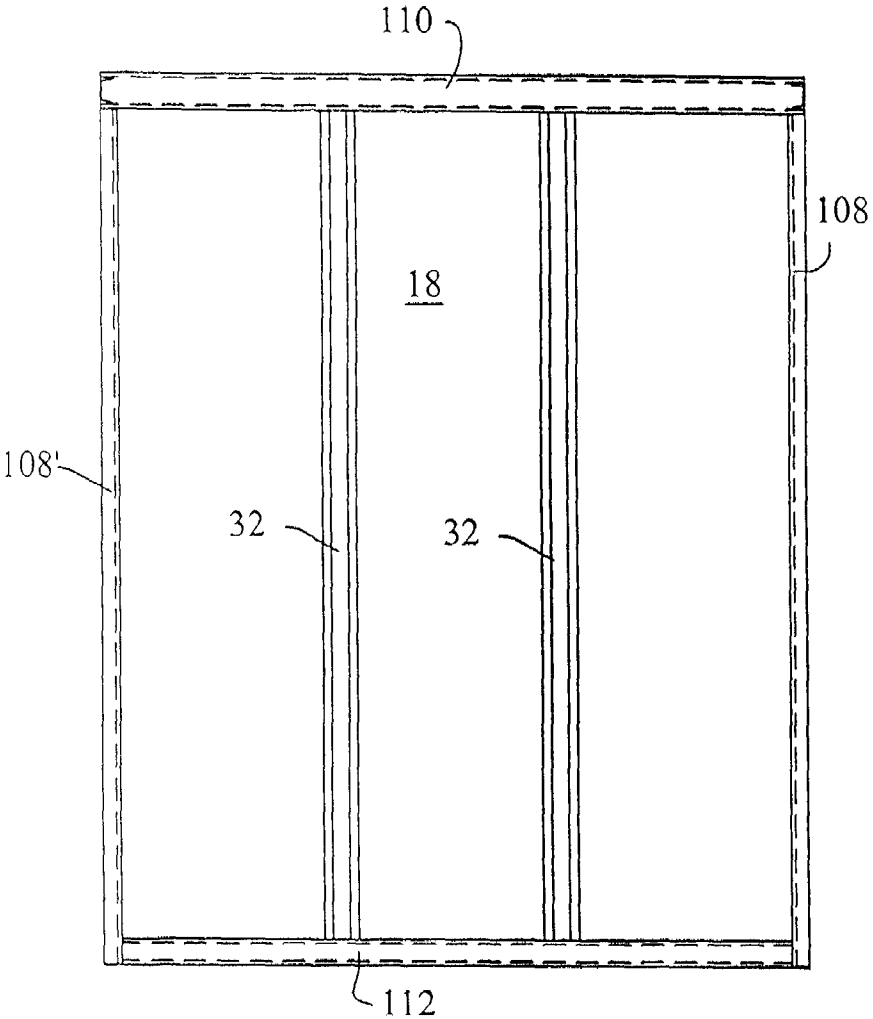
FIG. 4 shows a side view of the rear wall used in the modular prison cell shown in FIG. 1.

The thickness of the plate steel used to fashion rear wall 18, the left side wall 22, and the right side wall 20 must be great enough to withstand any impact created by the prisoner incarcerated within the cell, as prisoners will often test the strength of the means by which they are confined. Consequently, the walls used in this application must be able to withstand the force created by a prisoner striking the inner surface of the wall. Referring now to FIGS. 2, 3, and 4, wall supports 32 extend from the lower edge to the upper edge of side and rear walls 18, 20, 22 to further increase the wall strength and further reduce the odds of escape for a prisoner.

Figure 1B:
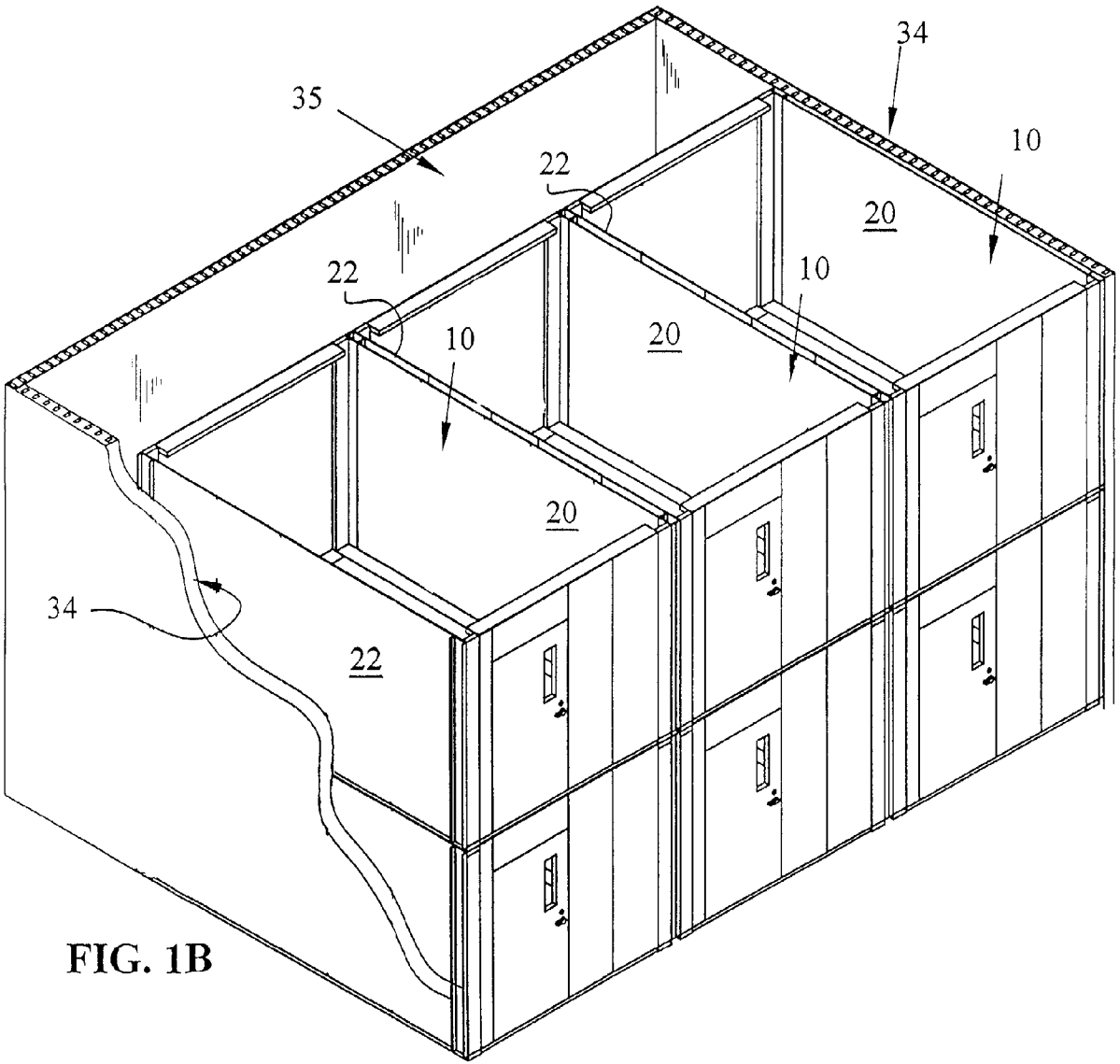
FIG. 1B is a perspective view of a plurality of modular prison cells similar to that shown in FIG. 1A being arranged in a cell block formation.

Referring now to FIG. 1B, a two-story cell block is shown, comprising six individual modular prison cells 10. The individual prison cells 10 are arranged in a cell block 11 with a cinder block frame 34 being located along the rear of all the individual cells 10 and extending along all sides of prison cells 10, except the front and those sides concealed by an adjacent prison cell. As shown in FIG. 1B, the cinder block 34 wall is arranged in a spaced relation from the back wall, to define a chase 35 for mechanicals such as heating or plumbing. In the preferred embodiment, the chase is 36" minimum. As can be seen in this perspective view, a double wall is formed between adjacent prison cells and formed by adjacent and back-to-back walls 20, 22, with a single wall being located at the ends of the cell block. The inclusion of a cinder block frame 34 increases the strength of the prison cells located at the ends of the block, thereby providing greater security in retaining the prisoners therein. The wall supports may be affixed to the walls via any manner well known, such as tack welding or bolting. While the embodiment shown in FIG. 1B is shown with a cinder block surround, it should also be appreciated that other structural walls could be made, or that combination walls, such as cinder block along the sides, with steel framing along the back side, could be used.

Referring now to FIG. 2, front wall 24 includes a door 26, a front fascia 28, an inner front wall 30, and a plurality of C-channel supports 31. Door 26 may be constructed from any material having sufficient strength to provide that the door 26 functions as a barrier to the incarcerated. Generally the door 26 includes a lock (not shown) and may be operatively connected to the front wall 24 in any one of numerous well-known manners. For example, in the present embodiment, door 26 is hingeably connected to front wall 24 and may pivot about the hinges in an outward or inward direction. However, a mechanism allowing door 26 to glide along a track means away from the opening may also be employed as desired.

Front fascia 28 provides for a decorative covering on the front wall 24, as this outer surface will be the only outer surface visible in the final assembly. In order to preserve the integrity of front fascia 28, an inner front wall 30 is located within the prison cell 10, and is adjoined to front fascia 28 via a plurality of I-beam supports 31. This ensures that any damage the incarcerated prisoner purports upon the front wall 24 will not harm the look of front fascia 28.

Referring now to FIG. 3, an exterior view of left side wall 22 is shown. Left side wall 22 comprises a portion of modular prison cell 10. A plurality of support members 32 can be seen extending vertically along the exterior of left side wall 22 from base C-channel 100 located near the lower portion of left side wall 22 upwards toward top C-channel 104. Top C-channel 104 and base C-channel 100 extend from a front C-channel connector 52 rearwardly to rear C-channel 102. As can be seen, rear C-channel 102 extends beyond rear edge 108 of left side wall 22, thereby strengthening rear edge 108 and preventing a prisoner incarcerated within modular prison cell 10 from exerting a sufficient force capable of bending or separating rear edge 108 of left side wall 22 from rear wall 18. Rear C-channel 102 and front C-channel connector 52 extend from the base foundation upon which modular prison cell 10 rests upwards until contacting C-channel channel 106.

As can be seen in FIG. 3, connector 52 and rear C-channel 102 are both orientated such that the opening of the C-channels is directed away from the interior of the modular prison cell 10. Lower C-channel 100, upper C-channel 104 and C-channel 108 are all orientated with the flat portion of the C-channel being applied to the external surface of wall 20. The lower edge of lower C-channel 100 is positioned relative to left side wall 20 such that the lower edge of left side wall 20 and the lower edge of lower C-channel 100 are substantially flush. Likewise, upper C-channel 104 shall be positioned in a manner so that the upper edge of upper C-channel 104 and the upper edge of left side wall 20 are substantially flush. In addition, as rear C-channel 102 and connector 52 are also flush with the upper edge of left side wall 22, a substantially planar surface is formed between the upper portion of upper C-channel 104, the top edge of connector 52 and the top edge of rear C-channel 102. This upper planar surface is also offset laterally, thereby forming a landing upon which a plurality of C-channels 31 may extend transversely across modular prison cell 10. Placed upon these C-channels 31 may be a roof (not shown) protecting the occupant of the interior of modular prison cell 10 from the elements, if it is the top row of cells, or can be a floor for the next row of cells.

Referring now to FIG. 4, rear wall 18 is shown as viewed from the exterior of modular prison cell 10. Rear wall 18 includes a plurality of wall supports 32 extending vertically from lower rear C-channel 112 to upper rear C-channel 110. Upper rear C-channel 110 has a length approximately the equivalent to the width of rear wall 18. However, lower rear C-channel 112 possesses a length slightly smaller than the width of rear wall 18 as lower rear C-channel 112 contacts rear C-channel 108 and rear C-channel 108'. Both upper C-channel 110 and lower C-channel 112 on rear wall 18 are orientated such that the back of the C-channel is orientated on the outside surface of the rear wall 18 and the opening of the C-channels orientated away from the rear wall 18. Rear C-channels 108 and 108', however, are affixed to left side wall 20 and right side wall 22, respectively, with the overlap discussed above in respect to right side wall 20 being the portion shown on this drawing. Upper rear C-channel 110 also partially functions as a structural member, thereby providing lateral support to the rear wall and decreasing the chance of deformation caused by an impact from the interior.

Figure 5:
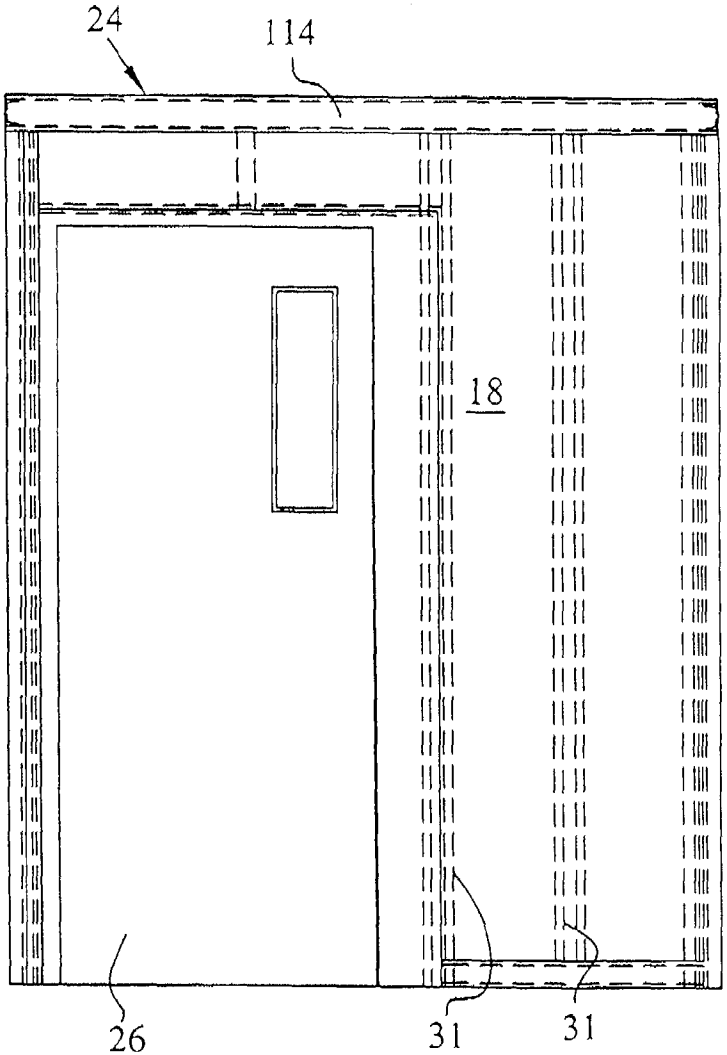
FIG. 5 shows a side view of the front wall of the modular prison cell shown in FIG. 1.

Referring now to FIG. 5, an exterior view of front wall 24 is shown. Included in front wall 24 is door 26, which may be movably affixed in any manner well known. Front wall 24 does not utilize wall strengthening members 32, as in the other walls 18, 20, 22, but rather is defined by double wall plates 28, 30, with a plurality of C-channels 21, fixed therebetween. C-channels 31 extend from the lower edge of front wall 24 to upper edge of front wall 24 vertically, thereby providing strength to the front wall 24. Extending laterally across the top edge of front wall 24 is upper front C-channel 114 which is affixed to front wall 24 in a manner similar to that which upper rear C-channel 110 is affixed to rear wall 18.

Figure 6:
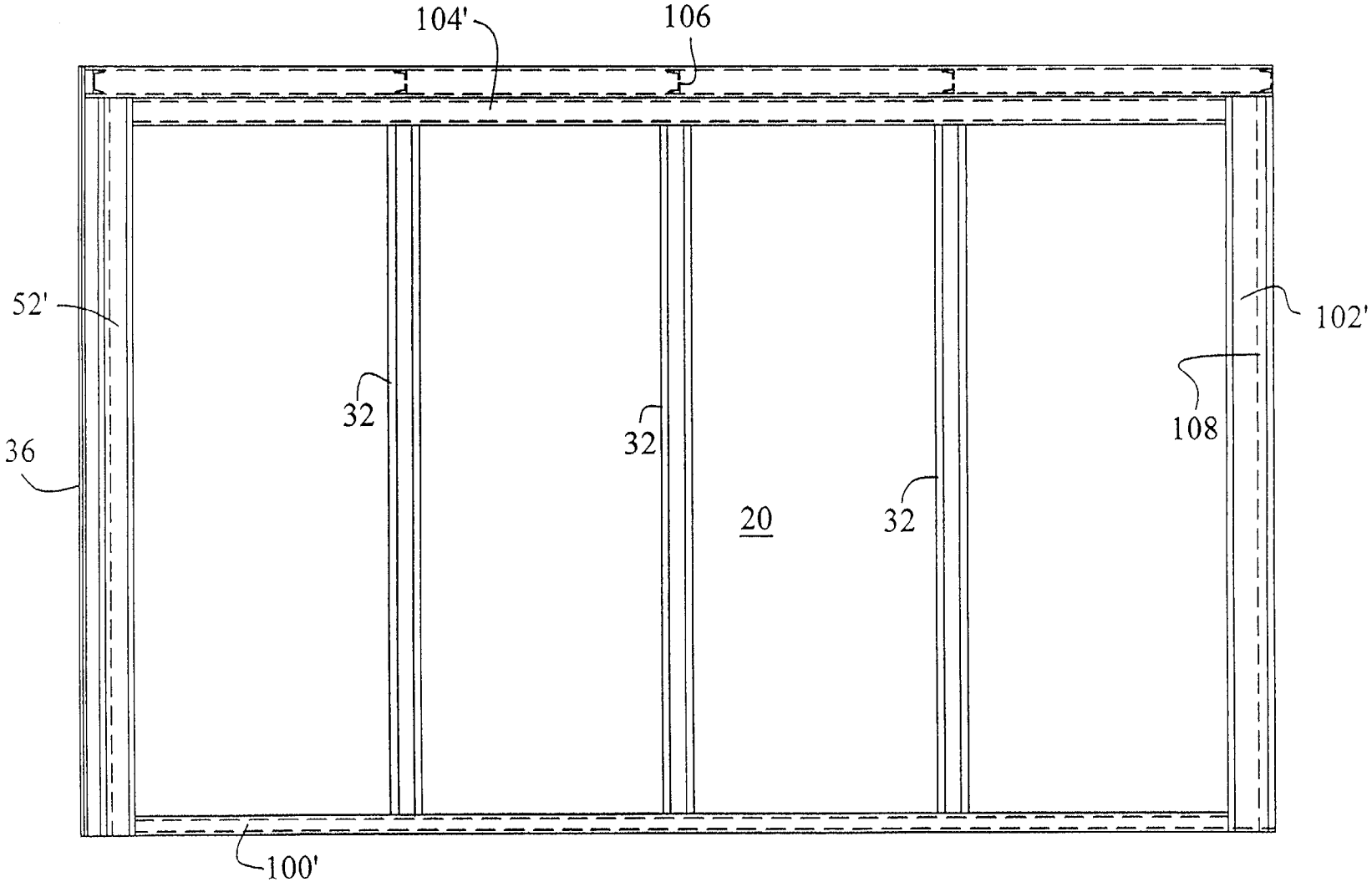
FIG. 6 shows a side view of the right side wall of the modular prison cell shown in FIG. 1.

Referring now to FIG. 6, an exterior view of right side wall 20 is shown. The arrangement of C-channels 52', 100', 102', 104' and 106' are substantially identical to that as described above with respect to right side wall 22. Aside from location within the modular prison cell 10, the significant difference between right side wall 22 displayed in FIG. 3 and left side wall 20 displayed in FIG. 6 is the presence of tongue 36 included in right side wall 20. Tongue 36 is located at the front portion of right side wall 20 and arranged in substantially the same manner that groove 38 was arranged on left side wall 22.

Figure 7:
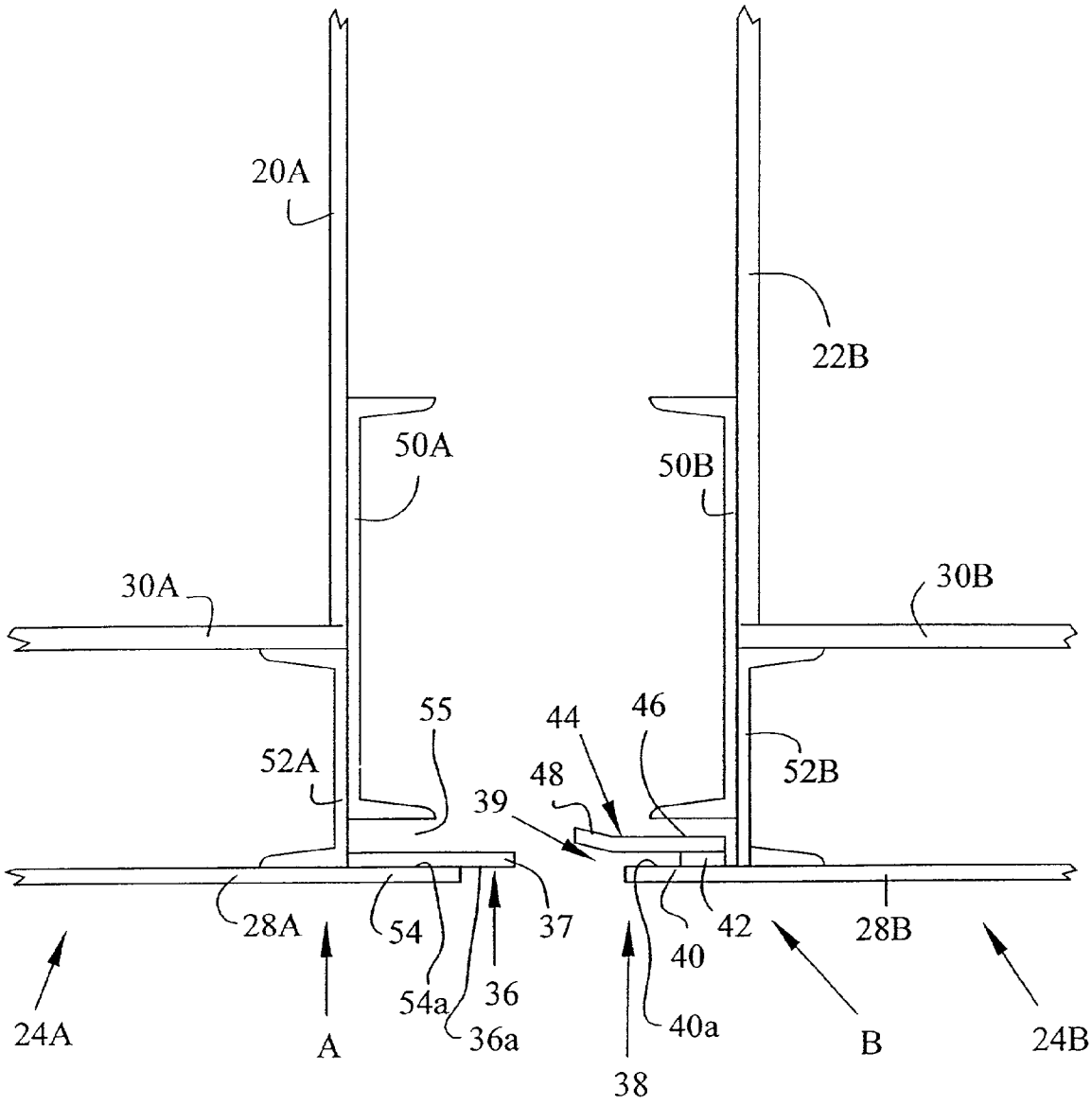
FIG. 7 shows a magnified view of a tongue and groove connection in accordance with the present invention of two separated modular prison cells similar to that shown in FIG. 1.
Figure 8:
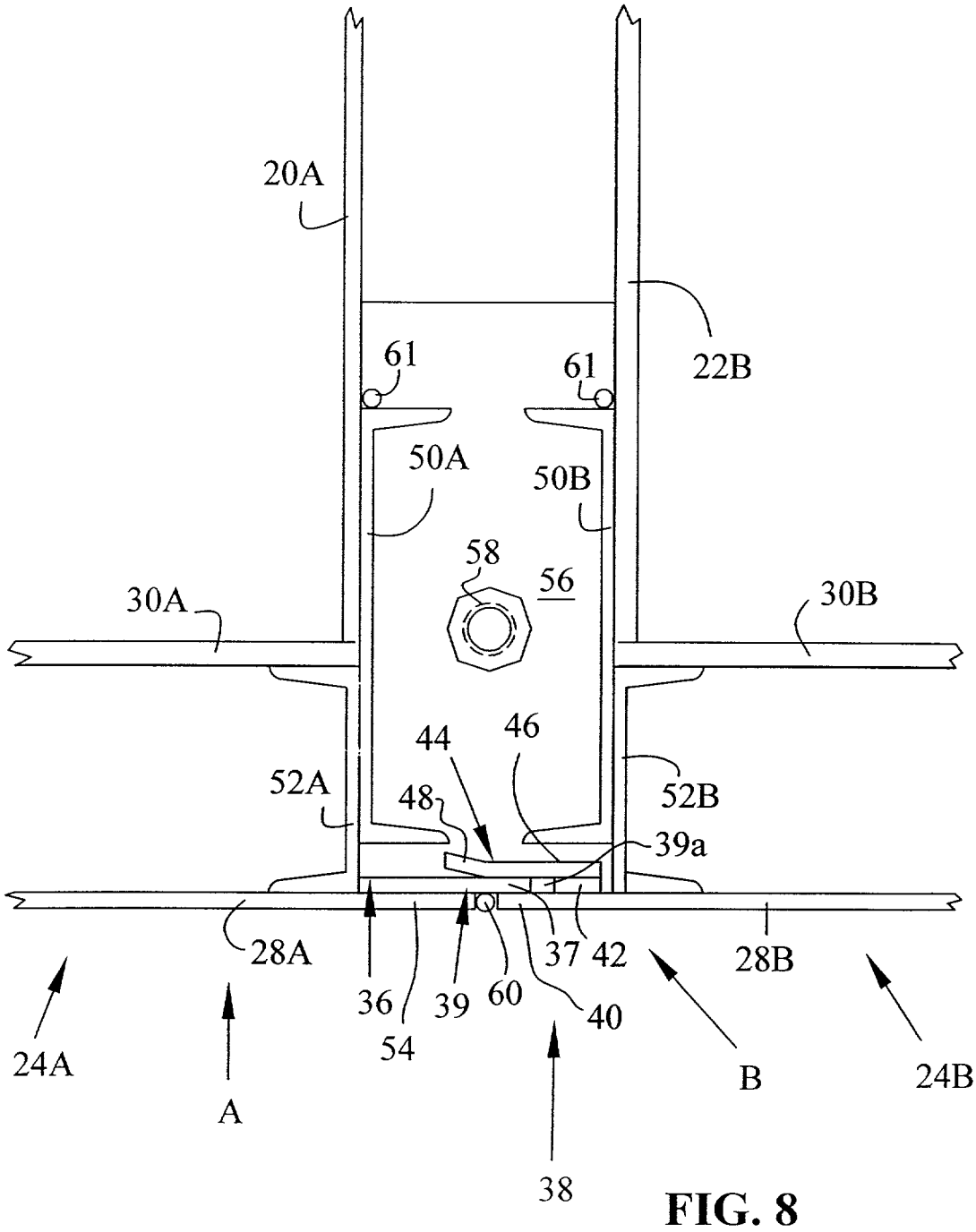
FIG. 8 shows the tongue and groove connection of FIG. 7 in which the tongue has been inserted into the groove in accordance with the present invention.

Referring now to FIGS. 7 and 8, the tongue and groove alignment mechanism to which the present invention relates is clearly shown. FIG. 7 represents a magnified view of the connection of a respective tongue 36 and groove 38, as shown in FIG. 2. Referring specifically to FIG. 7, a tongue and groove connection involving two separate modular prison cells is shown. For illustration purposes, the numerals identifying components associated with a first modular prison cell will include the identifier "A" following the numeral, whereas the numerals used to identify components on a second modular prison cell will be distinguished with a capital "B." For example, the front wall plate on the first modular prison cell is referenced by the designation 28A, whereas the front wall plate on the second modular prison cell is referenced as 28B.

During the assembly of a cell block, a plurality of prison cells 10 are arranged side-by-side with all the front walls 24 being orientated co-linearly and the rear walls 18 being orientated in the opposing direction. Additionally, except for the prison cells 10 located at the ends of each cell block, every prison cell 10 has two cells to which it adjoins, with one of the two cells being adjacent to the left wall 22 and the second cell being adjacent to the right wall 20. The tongue and groove alignment means shows the right side wall 20A of confinement cell A being placed adjacent to the left side wall 22B of confinement cell B.

Referring still to FIG. 7, the alignment accomplished by the tongue and groove guide connection 36, 38 will now be described in detail. Referring now to first confinement cell A, right side wall 20A abuts up to inner wall plate 30A in a perpendicular fashion. Right side wall 20A and inner front wall 30A may be adjoined via any manner that is well known, such as the inclusion of C-channel side wall connector 50A. Generally, right side wall 20A is affixed to connector 50A by welding, or the like. In the same manner, inner wall plate 30A would be affixed to a C-channel front wall connector 52A. Joined to connector 52A opposite inner wall plate 30A is front wall plate 28A, which extends substantially parallel to inner front wall 30A and is affixed to connector 52A in substantially the same manner by which connector 50A is affixed to prison cell A. Connector 52A may then be affixed to connector 50A via any manner well known.

Inner wall plate 30A is positioned such that its end is coincident with the flat surface of connector 52A. Thus, both the flat portion of connector 52 and the butt end of inner wall plate 30A are positioned against the flat surface of connector 50A. Front wall plate 28A, however, extends beyond connector 52A, to define an extended portion 54 extending opposite thereof.

Affixed to extended portion 54 is an extension plate generally indicated by numeral 36. Extension plate 36 is mounted to the same surface of front wall plate 28A upon which connector 52A is mounted. A portion of extension plate 36 extends beyond portion 54 to define a tongue, and indicated by numeral 37, extends past the end of extended portion 54 in a direction away from connector 52A. Tongue 37 is used in conjunction with a groove, generally indicated by numeral 38 and described below, to align two adjacent prison cells. As shown in FIG. 7, C-channel 50A is slightly laterally offset from extension plate 36, so as to define a slot 55, as will be described herein.

The groove 38 is designed to be used in conjunction with tongue 36 in order to properly align first confinement cell A and second confinement cell B. First, it is important to note, as is apparent to one ordinarily skilled in the art, the attachment of left side wall 22B to front wall 24B is substantially similar to the construction described above of right side wall 20A being attached to front wall 24A with the only difference being that tongue 37 is replaced with groove 38.

In this embodiment, groove 38 is comprised of three components: an outer groove guide wall 40, a groove spacer plate 42 and an inner extension wall generally indicated by numeral 44. As indicated above, this portion of second confinement cell B is substantially similar to the above-described portion of first confinement cell A except that the two portions are mirror images of each other. As such, outer groove guide wall 40 extending from front fascia 28B represents a mirror of extended portion 54 extending from front fascia 28A. However, the function of outer groove guide wall 40 and extended portion 54 differ as will be described below.

As mentioned above, a spacer plate 42 is affixed to outer groove guide wall 40 via any method well known. The method decided upon, however, must also allow inner groove guide wall 44 to be attached to outer groove guide wall 40, thereby sandwiching spacer plate 42 therebetween. Outer groove guide wall 40 extends beyond the edge of spacer plate 42, approximately a distance just greater than that which tongue 37 extends away from the edge of extended portion 54. Also extending away from spacer plate 42 located opposite outer groove guide wall 40 is inner groove guide wall 44. The inner groove guide wall 44 is comprised of a straight guide wall 46 and an angled guide wall 48. The straight guide wall portion 46 of inner groove guide wall 44 extends approximately the same distance from the spacer plate 42 as the outer groove guide wall 40, with the outer groove guide wall 40 and the inner groove guide wall 44 being substantially parallel. However, when outer groove guide wall 40 ceases to extend, the inner groove guide wall 44 bends to form angled guide wall portion 48. Angled guide wall portion 48 provides an angle to straight guide wall portion 46, which is greater than zero degrees, but less than ninety degrees.

Referring still to FIG. 7, groove 38 forms a channel 39 located between the portions of the outer groove guide wall 40 and the straight guide wall 46, extending beyond the edge of the spacer plate 42. As the outer groove guide wall 40 and the straight guide wall 46 extend beyond the spacer plate 42 a distance greater than the length of the tongue 37, and as the spacer plate 42 has a width greater than the width of the attachment 36, the channel 32 formed therein possess a cross-sectional area greater in both height and length than the cross-sectional area of tongue 37, thereby allowing insertion of tongue 37 into the groove 38.

Referring now to FIG. 8, the tongue and groove guide connection 36, 38 displayed in a separated configuration in FIG. 7, is shown here following the assembly of the first confinement cell A and the second confinement cell B. As can be seen in FIG. 8, the tongue portion 37 of attachment 36 slides into the groove 38 at channel 39, thereby ensuring first confinement cell A and second confinement cell B are properly aligned with front fascia A and front fascia B being in substantially the same plane. Additionally, this ensures the left side wall 20A of first confinement cell A and the right side wall 22B of the second confinement cell B are parallel to one another, ensuring proper alignment between the two confinement cells and further ensuring that the left side wall 20A and the right side wall 22B will not come into contact with each other. The presence of angled guide wall 48 provides a lead in to tongue 37 as the prison cells A, B are being joined. As tongue 37 moves toward prison cell B, it may come into contact with angled guide wall 48 and slide along the surface thereof, until properly aligned with channel 39. Once properly aligned with channel 39, tongue 37 may then be slidably inserted into groove 39, with lead-in section 48 being positioned in slot 55 (FIG. 7), ensuring proper alignment between the two components.

As can be seen in FIG. 8, the confinement cells A, B are assembled upon a base plate 56, having a guide stud 58 which extends vertically from the center of the base plate. The guide stud 58 and base plate 56 provide a means for leveling the joined confinement cells. For example, the first confinement cell A may be orientated such that C-channel connector 50A envelops half of the guide plate 56, with the guide plate 56 being located approximately half-way between the upper portion and the lower portion of the C-channel 50A. As such, when the tongue 37 is inserted in the groove 38, the opposite C-channel connector 50B will envelop the other half of the guide plate 56, thereby ensuring that the guide plate 56 is located substantially in the center of the area enclosed by C-channel connector 50A and C-channel connector 50B. Once the first confinement cell A and the second confinement cell B have been properly aligned, they are then affixed together in any manner well known. In this embodiment, the confinement cells are tack welded to the base plate 56 at 61, ensuring that the cells are not movable by the prisoners contained therein.

It should be appreciated that the end goal of the tongue and groove connection is not only to align the wall at their intersection, but also to assure that they extend in the same place. This is accomplished by using the inside surfaces of both of the plate portions 54 and 40 as the reference surface. As shown in FIG. 7, wall portion 54 has an inner surface 54*a*, while wall portion 40 has an inner surface 40*a*. As tongue 36 is fixed to surface 54*a*, outer surface 36*a* of tongue 36*a* is co-planar with inner surface 54*a*. Thus, when mated, the surfaces 36*a* and 40*a* are also co-planar, and are held in that configuration by wall 46. Thus, when several cells are assembled, the front walls 24A, 24B, etc., will all be in a common plane. In the preferred embodiment of the invention, the length of exposed surface 40*a* is longer than exposed surface 36*a*, such that a small gap 39*a* (FIG. 8) exists when fully assembled. However, if desired, the spacer plate 42 could be sized and/or positioned so as to form a stop surface for the end of tongue 37. Also preferably, a small gap exists at the end of plates 40 and 54, to receive a weld bead 60, which will hold first confinement cell A to second confinement cell B. It should be appreciated that this will take place in multiple places depending on the number of cells constructed.

Figure 9:
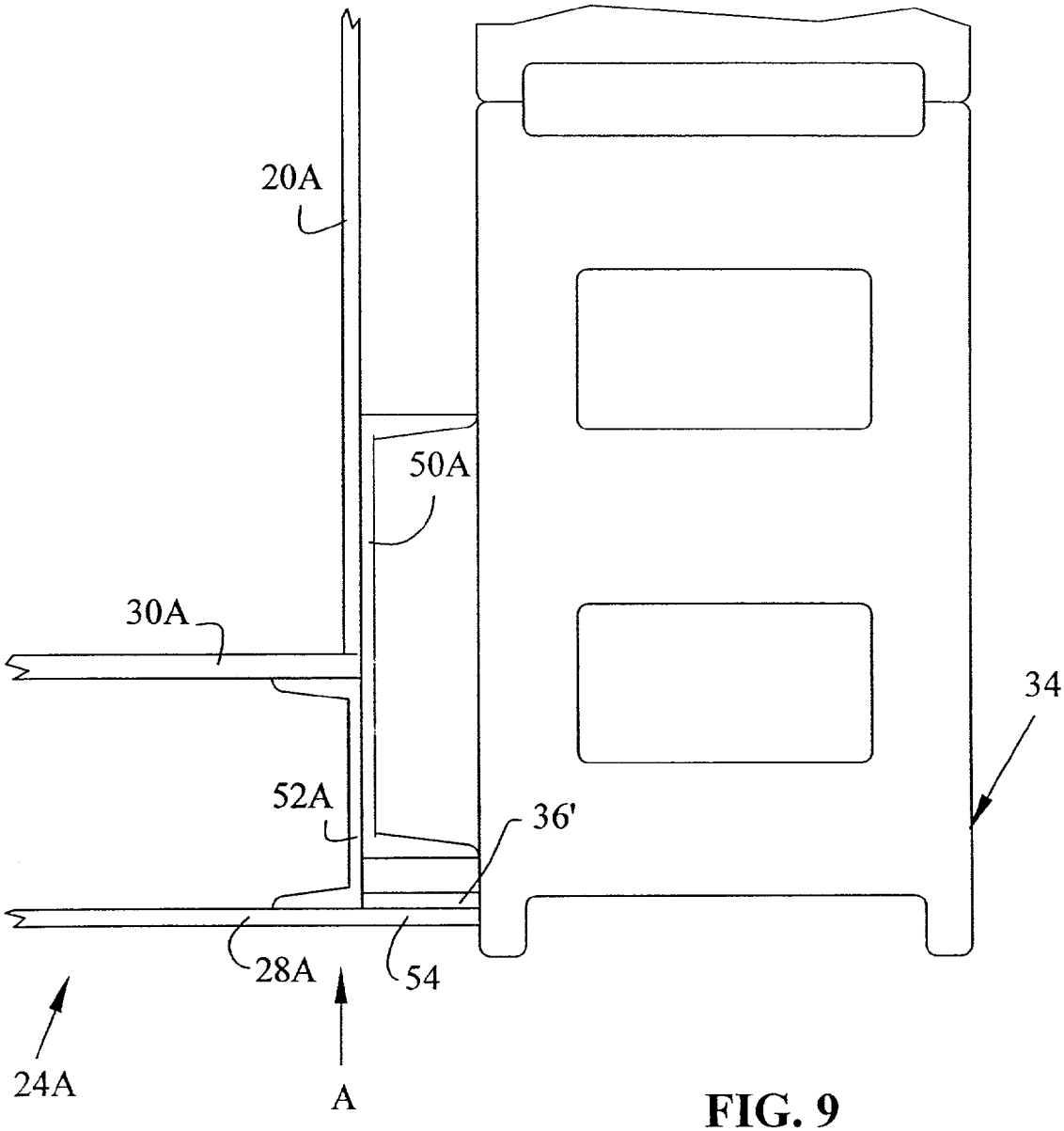
FIG. 9 shows a magnified view of an end cell abutting against a cinder block enclosure for the arrangement of the modular prison cell block shown in FIG. 1B.

Referring now to FIG. 9, the connection of an end modular prison 10 is shown adjacent to cinder block frame 34. The cinder block frame 34 is comprised of a plurality of cinder blocks arranged end-to-end and stacked to a height approximately equal to the height of the modular prison cell 10, or the top row, if multiple rows. The cinder blocks may be affixed to one another in any manner well known in the construction field, and preferably by mortar. In order to facilitate the alignment of the individual cell 10 with the cinder block frame 34, a modified tongue 36' is used, allowing extended portion 54 and the ends of connector 50 to be orientated in substantially the same plane. The ends of connector 50A and extended portion 54 may then be orientated so as to be in abutment with cinder block frame 34 and then may be affixed thereto via any manner well known in the art. Therefore, even though the individual cells 10 located at the ends of a cell block 11 include only single wall around the perimeter, the prisoners housed therein will be retained, as the cinder block frame 34 encompasses the cell block 11, preventing escape through the single walls along the perimeter of the cell block 11.

As explained above, FIG. 9 shows cinder block frame 34 abutting an individual cell 10 along the side normally including the tongue 36. As will be readily apparent to one possessing ordinary skill in the art, a prison cell located on the perimeter cell block 11 opposite the cell shown in FIG. 9 would require removal of spacer plate 42 and inner groove guide wall 44 so as to allow the cell to be properly aligned with cinder block frame 34 so that the ends of connector 50B and outer groove guide wall 40 are substantially planar. Again, this individual cell may be affixed to cinder block frame 34 by any manner well known.

Figure 10:
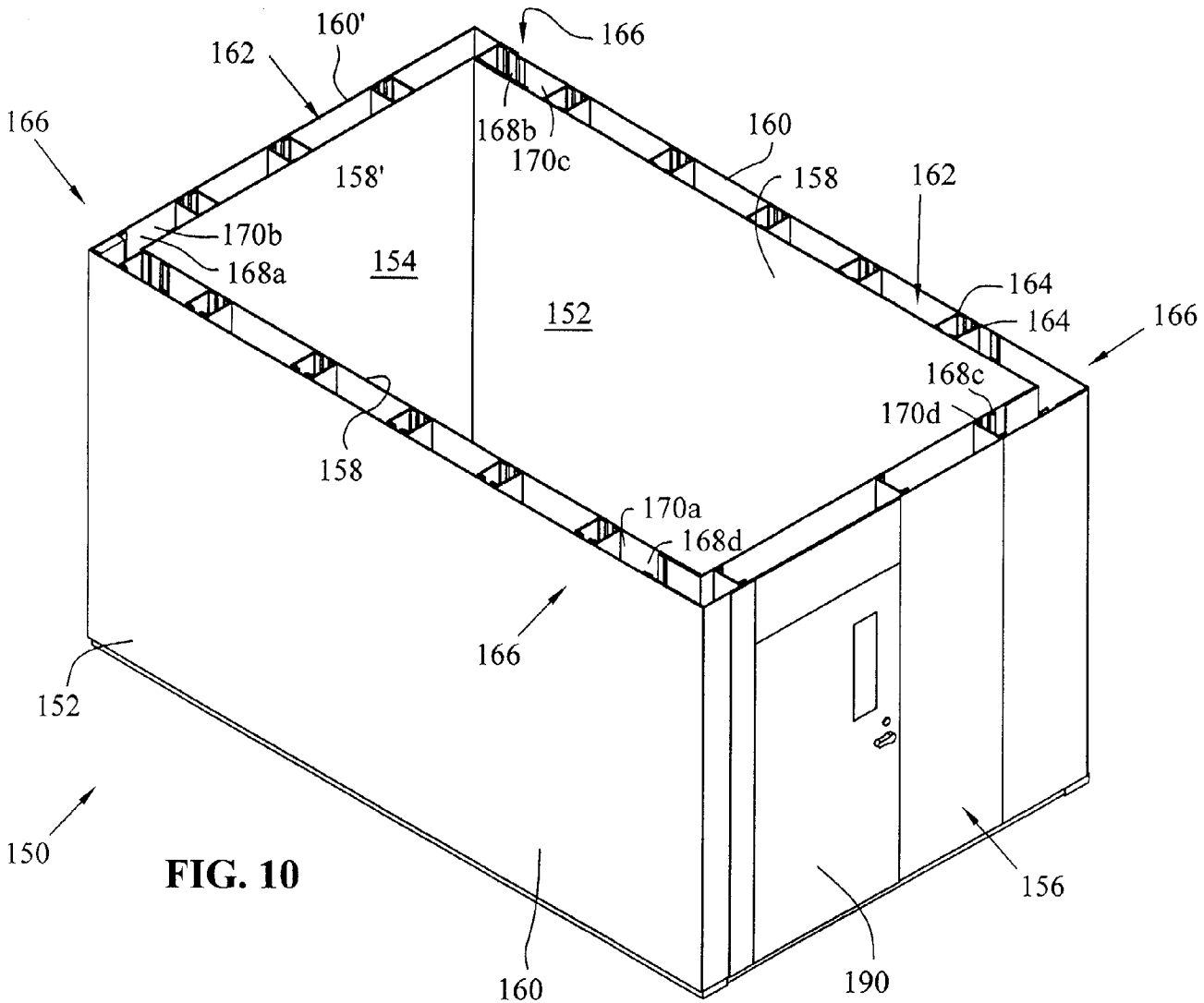
FIG. 10 shows a perspective view of a modular classroom employing four wall panels, each incorporating the tongue and groove design at the corners and having C-channel wall connectors, allowing for a double wall design, increasing the structural strength of the classroom.

Referring now to FIG. 10, another embodiment of a room structure is shown, where the room could be used for multiple purposes, but in the preferred embodiment, it is used as a modular classroom, generally indicated by numeral 150 is shown. Classroom 150 includes a pair of wall sections 152, a rear section 154 and a front section 156. As can be seen in the drawings, wall sections 152 include an inner wall 158 and an outer wall 160. In order to incorporate a double wall design, generally referred to as numeral 162, inner wall 158, and outer wall 160 of double wall design 162 are joined via a plurality of C-channel connectors 164, which extend between inner wall 158 and outer wall 160, with both walls 158, 160 being affixed thereto. C-channel connectors 164 extend substantially the entire height of the walls 158, 160 so as to provide support therein. Further, a plurality of C-channel connectors 164 are employed along the full height of the walls 158, 160 so as to further strengthen the walls in order to provide better protection to the occupants therein.

Figure 11:
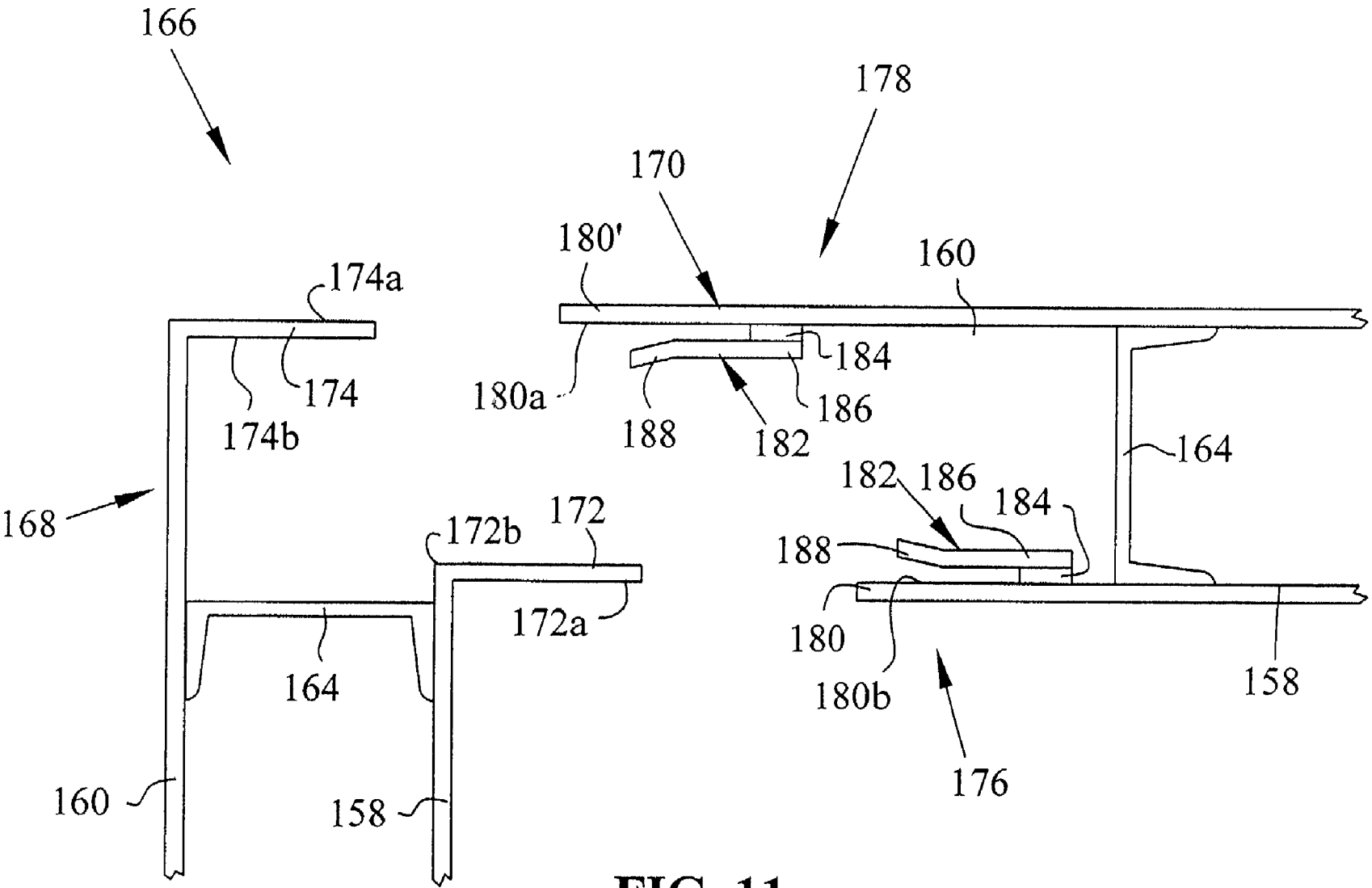
FIG. 11 shows a magnified view of two wall structures utilized in the classroom shown in FIG. 10 prior to assembly.

Referring still to FIG. 10, it is shown that rear section 154 also employs the double wall design 162 with a plurality of C-channel connectors 164 extending between an inner wall 158', and an outer wall 160'. As is generally indicated by numeral 166, a tongue and groove connection is employed between wall sections 152 and rear section 154 during the assembly process of classroom 150. As shown in FIGS. 10 and 11, every section 152, 154, 156 of classroom 150 includes a first end generally indicated by numeral 168 and a second end generally indicated by numeral 170, with first end 168 of every section 152, 154, 156 being comprised of substantially the same components. Likewise, second end 170 of each of the three types of sections 152, 154, 156 is also comprised of substantially the same components. It should be noted that in order to differentiate the first end and second end of the three types of sections 152, 154, 156, an indicator A, B, C and D has been added to the numerals so as to identify first end 168A and second end 170A as being on the same wall section 152. Further, first end 168B and second end 170B are both associated with rear section 154. Likewise, first end 168C and second end 170C and first end 168D and second end 170D are associated with other wall section 152 and front section 156, respectively.

Tongue and groove connection 166, located between any first end 168 and any second end 170 of the classroom 150 and displayed in FIG. 10, is shown in FIG. 11. First end 168 includes inner tongue 172 and outer tongue 174, with inner tongue 172 extending from inner wall 158 and outer tongue 174 extending from outer wall 160. Likewise, on second end 170, outer wall 160 includes outer groove 178 and inner wall 158 includes inner groove 176. Inner tongue 172 and outer tongue 174 maintain the same basic structure, a smooth steel portion having sufficient strength so as to ensure that once inserted into a mating groove, the wall attached thereto does not move relative to the groove. Likewise, inner groove 176 and outer groove 178 have substantially the same structure, and have substantially the same structure as groove structure 38 discussed above.

As shown in FIG. 11, grooves 176, 178 include an outer groove guide wall 180, an inner groove guide wall generally indicated by numeral 182 and a groove spacer plate 184. Inner groove guide wall 180 is an extension of inner wall 158 with respect to inner groove 176, and outer groove guide wall 180' is an extension of outer wall 160 with respect to outer groove 178. Mounted to the same surface of outer groove guide wall 180 to which C-channel connector 164 is mounted, is a groove spacer plate 184 having a width slightly greater than inner tongue 172 and outer tongue 174. In addition, mounted to spacer plate 184, opposite outer groove guide wall 180, is inner groove guide wall 182 having a straight portion 186 and an angled lead-in portion 188. As should be apparent to one possessing ordinary skill in the art, as spacer plate 184 has width greater than the tongues 172, 174, the tongues 172, 174 may be inserted into the grooves 176, 178, respectively.

Figure 12:
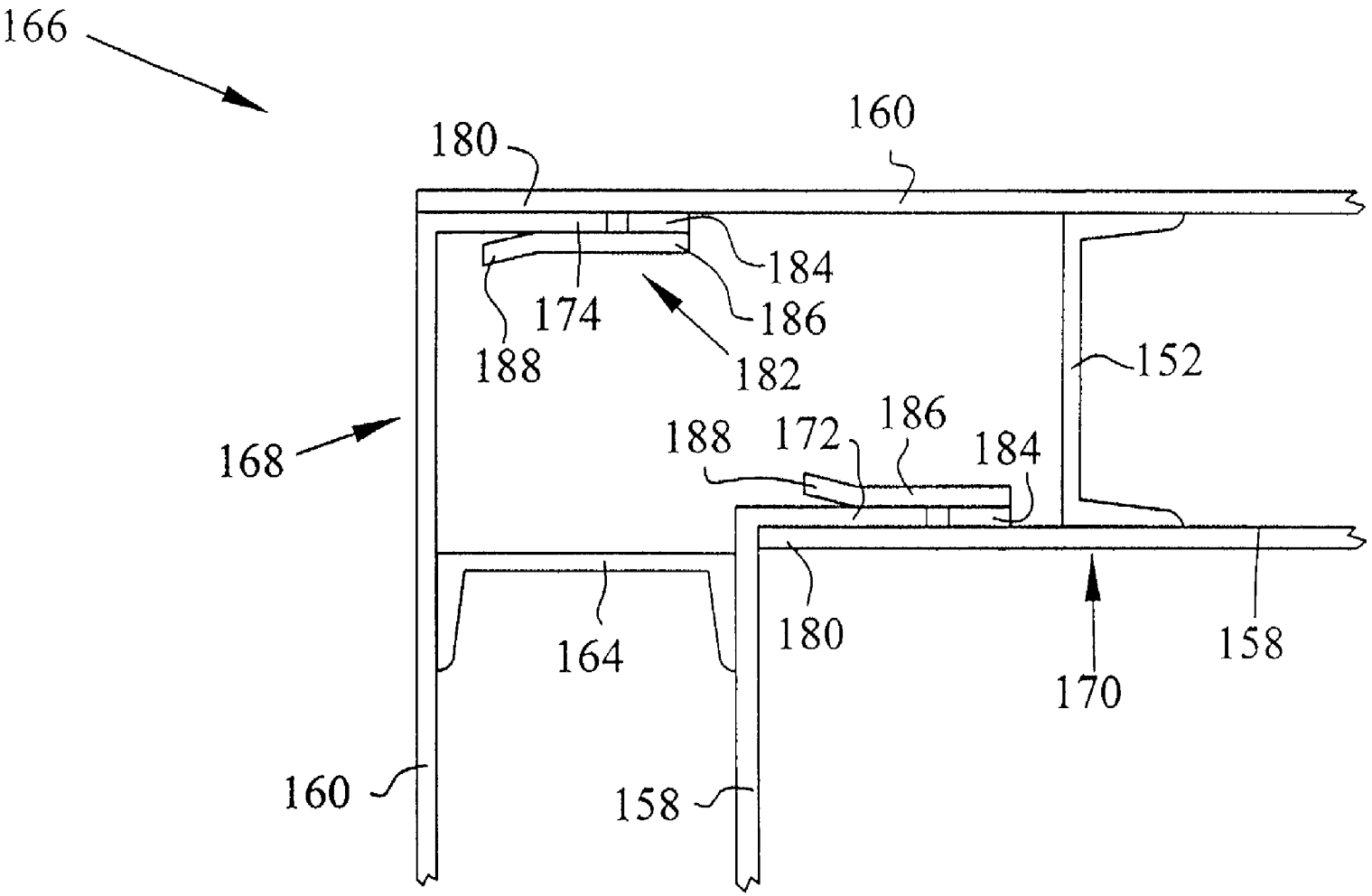
FIG. 12 shows a magnified view of a corner of the classroom shown in FIG. 10 after the wall structures have been assembled in accordance with the present invention.

Referring now to FIG. 12, the tongue and groove connector depicted in FIG. 11 is shown with the tongues 172, 174 being inserted into the grooves 176, 178, respectively. As can be seen in this figure, first end 168 is moved in the direction of second end 170 with inner tongue 172 being aligned substantially with inner groove 176. Likewise, outer tongue 174 becomes aligned with outer groove 178. As the tongues are being inserted into the groove, angled portion 188 functions as a "lead-in," whereby a lateral position of first end 168 relative to the lateral position of second end 170 adjusts until the tongues 172, 174 are in a position between outer groove guide wall 180 and inner groove guide wall 182. The tongues 172, 174 are then fully inserted into the grooves 176, 178 until inner wall 158 of second end 170 comes into contact with the inner wall 158 of first end 168, whereby insertion of first end 168 into second end 170 is no longer possible. It should also be noticed in FIG. 12 that when fully inserted, guide wall 180 extending from wall 160 fully overlaps the tongue 174. A bolt or other affixing means (not shown) may then be inserted through outer groove guide wall 180, inner groove guide wall 182, and the tongue located therebetween in order to ensure first end 168 does not become dislodged from second end 170. Likewise, welding or the like may be used at the mating location of the inner walls 158 and/or the mating location of the outer walls 160 in an effort to secure the two ends 168, 170 together. It should be noted that the angle formed between first end 168 and second end 170 is approximately a right angle having 90°, allowing classroom 150 to take the profile of either a square or a rectangular shape.

Referring to both FIGS. 10 and 12, following the insertion of the tongues 172, 174 attached to first end 168 into the grooves 176, 178 of the second end 170 at one position this process is then repeated at the remaining corners of classroom 150, to complete the assembly. As should be readily apparent to one possessing ordinary skill in the art, if it is desired that the classroom 150 have a shape resembling that of a square, rear section 154 could be replaced by a wall section 152 and further, front section 156 may also be replaced by wall section 152. However, replacement of this kind would require a door 190 to be added via a manner well known so as to allow entering into and exiting from the classroom 150. It should be appreciated that shapes other than rectangles could also be accommodated using the teachings of the present invention.

With reference to FIG. 11, the alignment of the various walls will be discussed. In a like manner to that described above with reference to FIG. 7, wall extension 180' has an inner surface 180*a,* and wall 180 has an inner surface 180*b.* Likewise, tongues 172, 174 have surfaces 172*a,* 174*a* which align and co-act with respective surfaces 180*b* and 180*a.* Moreover, each of the groove extension plates 182 co-acts with surfaces 172*b,* 174*b,* to assure a perpendicular connection.

With respect now to FIGS. 13–17, another embodiment of the invention will be shown as follows. With respect first to FIGS. 13A and 13B, a further embodiment of cell assembly is shown at 210, where a left-hand cell is shown at 212 in FIG. 13A, and a right-hand cell is shown at 214 in FIG. 13B. In both of the views of FIGS. 13A and 13B, the cells 212 and 214 are shown with a common wall formed generally at 216. It should be appreciated that in the embodiments of FIGS. 13A and 13B, each of the walls are comprised of multiple sections.

Figure 13A:
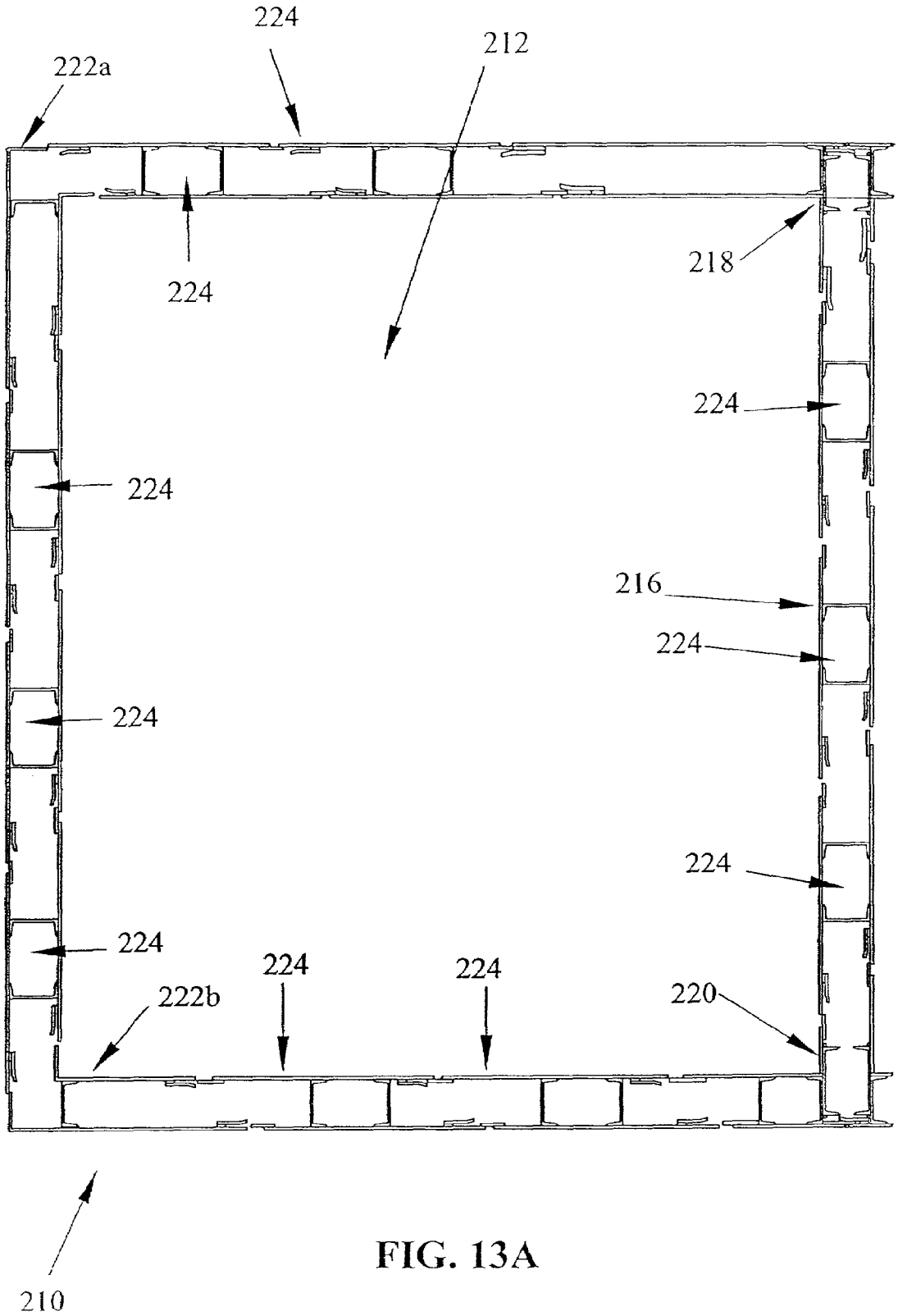
FIG. 13A is the left-hand side view of a first cell of a multi-cell configuration of the further embodiment.

With respect first to FIG. 13A, the cell is formed from two T-wall portions 218 and 220, corner pieces 222A and 222B, and wall panel sections 224. To be more exact, three wall panel sections 224 extend intermediate the two T-members 218 and 220; three wall panel sections 224 extend between the two corner pieces 222A and 222B; two wall panel sections 224 extend between T-wall portion 218 and corner portion 222A; and two wall panel portions 224 extend between T-wall panel 220 and corner portion 222B.

Figure 13B:
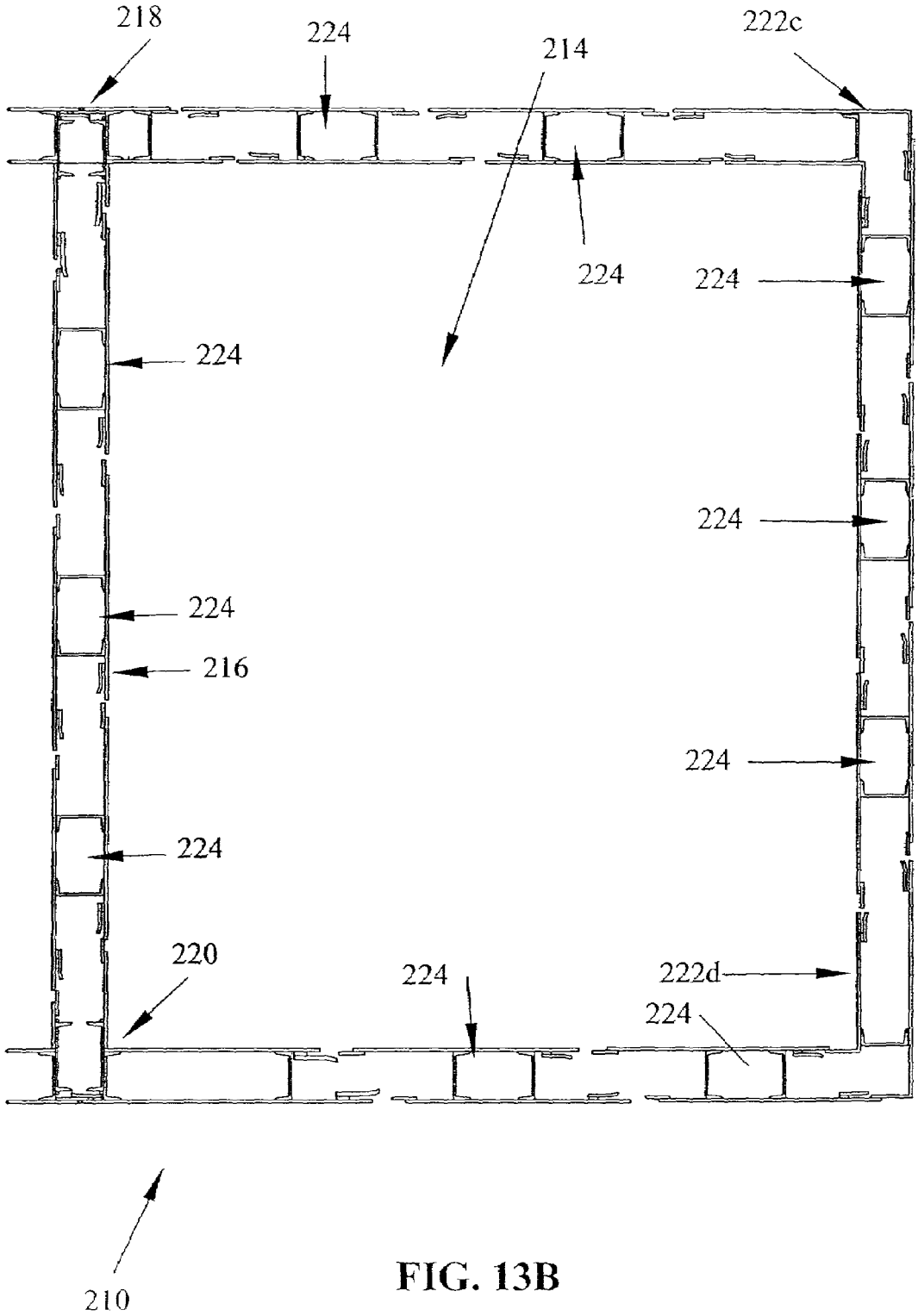
FIG. 13B is the right-hand side cell.

In a similar manner, as shown in FIG. 13B, the right-hand cell 214 is formed by the common wall 216 as described above, with two wall panel portions 224 extending between T-wall portion 218 and corner member 222C, and two wall panel portions 224 extending between T-wall member 220 and corner member 222D. Finally, cell 214 is comprised of three wall panel portions 224 extending between corner members 222C and 222D.

With respect now to FIG. 14, T-wall portion 220 will be described in greater detail. T-wall portion 220 is comprised of two halves, L-shaped portion 220A and counterpart L-shaped portion 220B. L-shaped portion 220A is comprised of two wall panel sections 232 and 234 spaced apart by channel sections 236. At the outer ends of wall panel portions 232 and 234, are positioned grooves formed by a spacer plate 237 and a lead-in plate 238 forming a groove 240. At the outer end of plate 234 is a spacer plate 242 having a lead-in plate 244, thereby forming a groove 246. At the opposite end of plate 234, a spacer plate 250 and lead-in plate 252 thereby defines a groove at 254. The upper part of the L-shaped wall 220A is formed by a plate section 260 attached to channel member 262, which is attached in a back-to-back relation with channel portion 236. Finally, at the upper end of wall plate 260 is an extension plate section 264, thereby defining a tongue as will be described in further detail.

Figure 14:
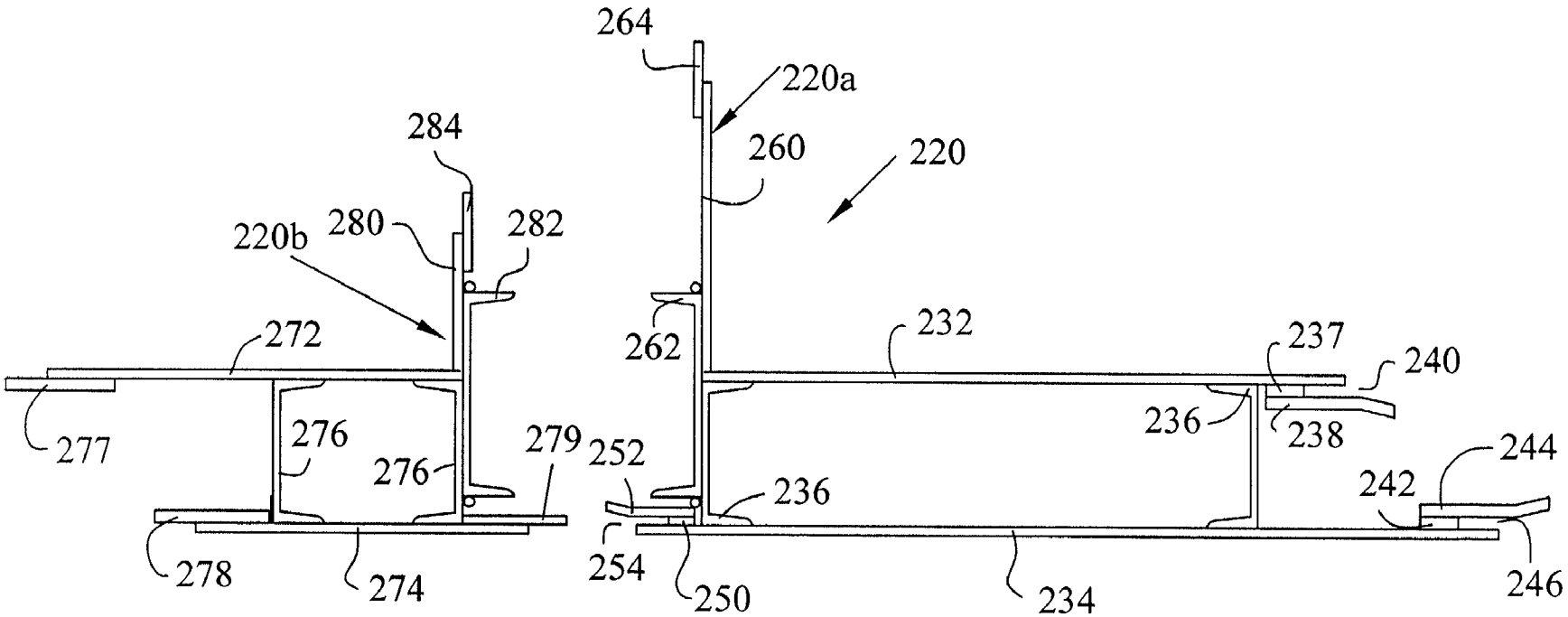
FIG. 14 is a top plan view of a first T-wall section slightly separated.
Figure 15:
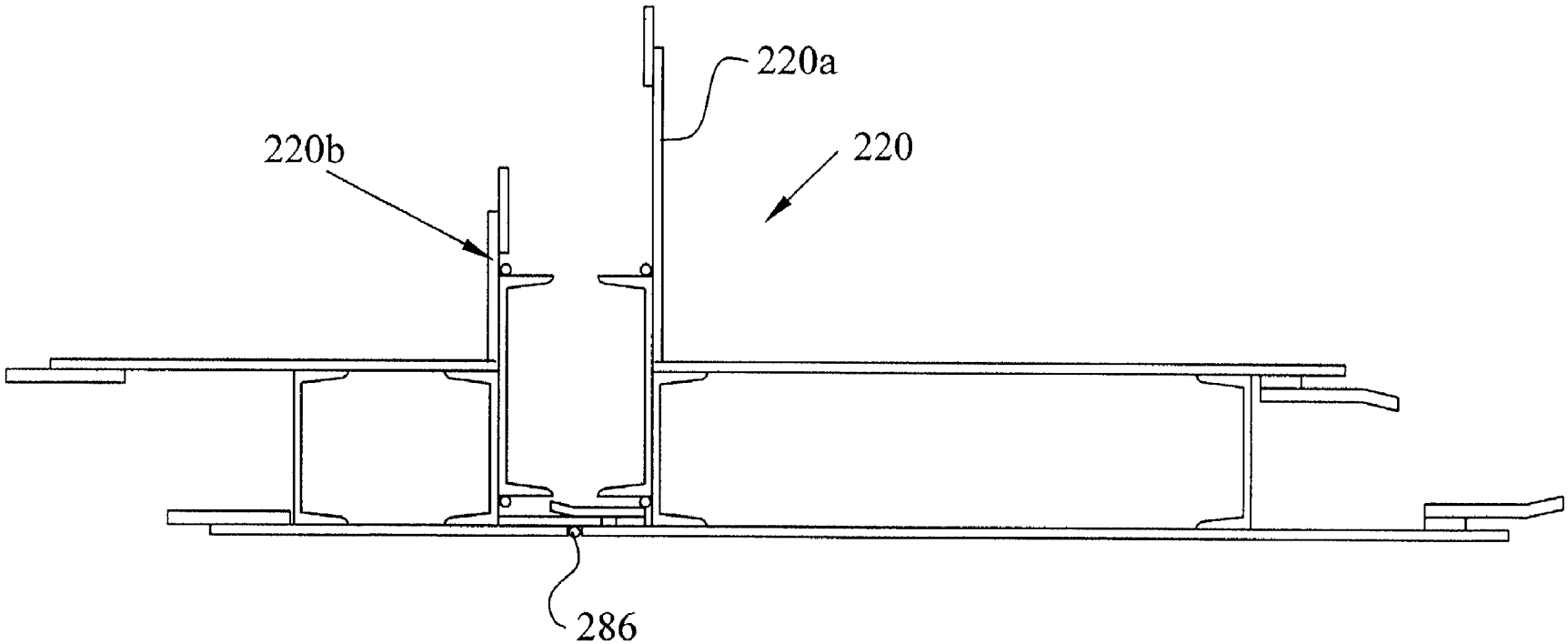
FIG. 15 is a top plan view similar to FIG. 14 showing the two wall portions of the T in a fully mated condition.

With reference still to FIG. 14, L-shaped portion 220B is defined by two panel sections 272 and 274 spaced apart by channel sections 276. At the outer end of wall plate 272 is an extension plate section 277, thereby defining a tongue section. At the outer end of plate portion 274 is an extension plate section 278, thereby forming a complementary tongue section. Wall plate 280 extends upwardly from wall plate section 272 and is fixedly attached thereto by way of a channel 282, which is fixed to the wall plate 280 and to channel 276 in a back-to-back relation. At the upper end of plate 280 is an extension plate portion 284, thereby forming a further tongue section. As should be appreciated, the two L-shaped members 220A and 220B can be positioned together, as shown in FIG. 15, with tongue member 279 positioned in groove 254 and fixed in plate by a weld bead 286. It should be further appreciated to those skilled in the art that the plates and channel sections as described above, are in the preferred embodiment, all welded in place by any welding technique which is known in the art to fix the metal plate in channel sections rigidly together.

With respect now to FIG. 16, T-wall portion 218 will be described in greater detail. T-wall portion 218 is comprised of two halves, L-shaped portion 218A and counterpart L-shaped portion 218B. L-shaped portion 218A is comprised of two wall panel sections 332 and 334 spaced apart by channel sections 336. At the outer ends of wall panel portion 332 is a spacer plate 337 and a lead-in plate 338 forming a groove 340. At the outer end of plate 334 is a spacer plate 342 having a lead-in plate 344, thereby forming a groove 346. At the opposite end of plate 334, a spacer plate 350 and lead-in plate 352 thereby defines a groove at 354. The lower part of the L-shaped wall 218A is formed by a plate section 360 attached to channel member 362, which is attached in a back-to-back relation with channel portion 336. Finally, at the upper end of wall plate 360 is a spacer plate section 363, lead-in plate 364, thereby defining a groove 366 as will be described in further detail.

With reference still to FIG. 14, L-shaped portion 218B is defined by two panel sections 372 and 374 spaced part by channel sections 376. At the outer end of wall plate 372 is an extension plate section 377, thereby defining a tongue section. At the outer end of plate portion 374 is an extension plate section 378, thereby forming a complementary tongue section. Wall plate 380 extends upwardly from wall plate section 372 and is fixedly attached thereto by way of a channel 382, which is fixed to the wall plate 380 and to channel 376 in a back-to-back relation. At the upper end of plate 380 is an extension plate portion 383, and a lead-in plate 384, thereby forming a further groove section 386. As should be appreciated, the two L-shaped members 218A and 218B can be positioned together, as shown in FIG. 16, with tongue member 379 positioned in groove 354 and fixed in plate by a weld bead 386.

Figure 17:
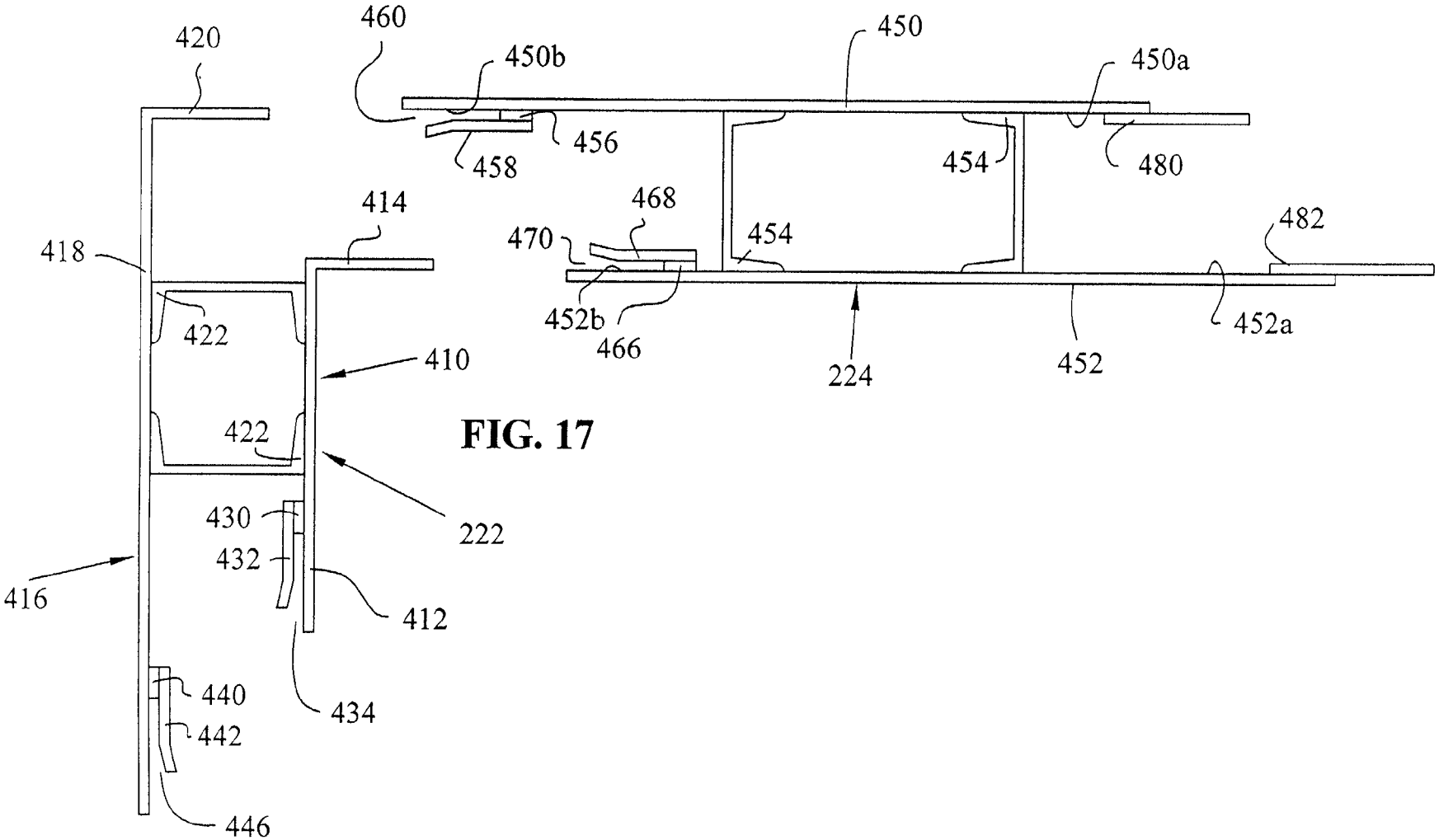
FIG. 17 is a top view of a short wall panel portion and a corner panel portion.

With respect now to FIG. 17, corner member 222 is formed by a right-angle plate member 410 having a first plate section 412 and a transverse section at 414. Corner section 222 further includes a wall section 416 having a first wall section 418 and a transverse wall section 420. The two wall sections 410, 416 are fixed together by way of channels 422. At the outer end of plate section 412 is a spacer plate section 430 and a lead-in plate section 432, thereby forming a groove at 434. At the lower end of plate section 418 is a spacer plate 440 having a lead-in plate 442, thereby defining a groove 446. It should be further appreciated that transverse wall sections 414 and 420 form tongues for complementary grooves in the wall panels, as will be described.

Finally, with respect still to FIG. 17, wall panel section 224 is shown as including plate sections 450 and 452 spaced apart by channel sections 454, where one end of plate section 450 includes a spacer plate 456 and a lead-in plate 458, thereby defining a groove at 460. In a like manner, an end of plate 452 includes a spacer plate 466, a lead-in plate 468, thereby defining a groove at 470. At the opposite ends of plates 450 and 452 are extension plate sections 480 and 482, respectively, thereby forming further tongue sections.

It should be appreciated then that any of the tongues 264, 284; 277, 278 (FIG. 14); 377, 378 (FIG. 16); 414, 420; 480, 482 (FIG. 17) will interlock with any of the grooves 240, 246 (FIG. 14); 340, 346; 366, 386 (FIG. 16); 434, 446 (FIG. 17); and 460, 470 (FIG. 17). Thus, as described above with respect to FIGS. 13A and 13B, a multi-cell wall construction can be provided by the use of identical wall panels 224 and corner members 222 and interlocking them with T-wall sections 218 and 220. It should be understood from FIGS. 17A and 17B that any of the wall sections can be left out to provide a door section as previously described in any of the other embodiments. It should be understood from this embodiment, that is, the embodiment of FIGS. 13–17, that providing the wall sections in short panels, the secure cells could be constructed in an already existing non-secure building, whereby the individual wall panels can be brought in through doors or windows of the building and erected within the existing building.

Also, in the preferred version of all of the embodiments (FIGS. 1–17), the tongue is comprised of steel sheet or steel bar, which is 3/16' in thickness. Furthermore, the spacer plate is, in the preferred embodiment, ¼' in thickness.

Figure 16:
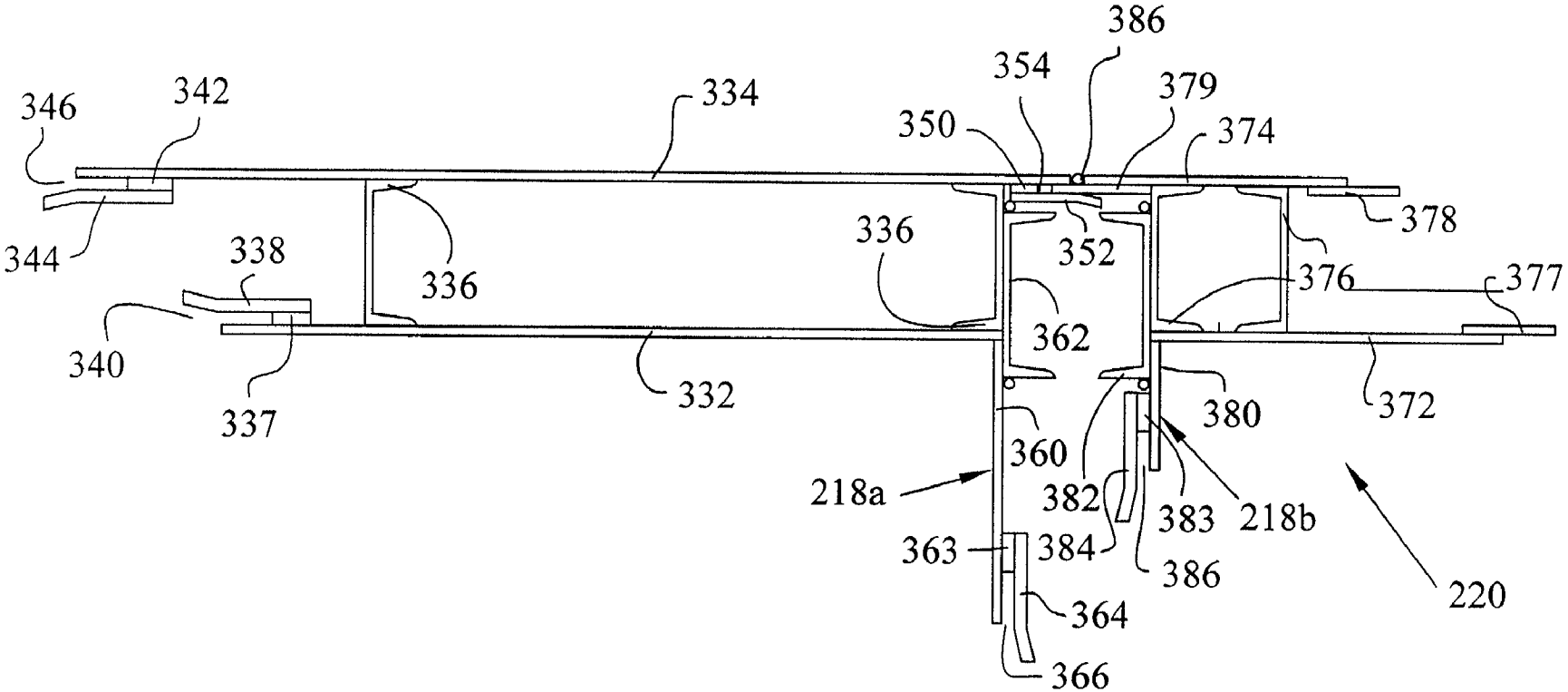
FIG. 16 is a view similar to that of FIG. 15 of a second T-wall portion.

Furthermore, it should be understood that the T-walls 218, 220, shown in FIGS. 14–16, operate as to alignment, in substantially the same manner as that described in relation to FIG. 7. Furthermore, it should be appreciated that corner members 222 operate in substantially the same manner as corner members 166 described in FIG. 11. Finally, the straight wall sections 224 have grooves 460, 470 at one end and tongues 480, 482 at the opposite end, thereby allowing multiple straight sections 224 to be assembled, one to the other.

It should also be understood that the lateral staggering of the tongues and grooves also assists in multiple ways. First, as the embodiment of FIGS. 13–17 is comprised of a plurality of sections, the staggering assists in the co-planarity of the assembled walls. That is, and with reference to FIG. 17, wall portions 450 have at opposite ends inner surface portions 450*a* and 450*b*, while wall 452 has like surfaces 452*a* and 452*b*. When two wall portions 224 are to be attached together, the lateral staggering of tongues 480, 482 and grooves 460, 470 will assure the co-planarity of adjacent surfaces 450*a*, 450*b*; and 452*a*, 452*b*.

The lateral staggering has other advantages. The staggering also allows for better sound deadening capabilities, as there is no straight path for the sound. The same holds true for fire prevention.

While this invention has been described as having exemplary embodiments, the present invention may be further modified within the spirit and scope of this disclosure. The application is, therefore, intended to cover any variations, uses, or adaptations of the invention using its general principles. Further, this application is intended to cover such departures from the present disclosure as come within known or customary practice in the art to which this invention pertains.

I claim:

1. A modular secure wall structure defining a plurality of rooms, each room having a front wall, a rear wall, and a pair of side walls, where some of said walls may be shared between rooms, said wall structure comprising:

at least two of said walls are joined in abutting relation, with the walls being formed by steel plates;

a tongue extending from one of said steel plate walls of a first room, said tongue being formed by a steel strip attached to an inner surface of said steel plate wall and extending beyond a length thereof; and a groove extending from an adjoining steel plate wall of a second room, said groove being defined by an inner groove guide wall being spaced from said second steel plate wall, said groove includes said inner groove guide wall, a spacer plate, and an outer groove guide wall, with a channel being formed therebetween, said channel having a larger cross-sectional area than said tongue;

said tongue being slidably insertable in said groove whereby insertion of said tongue into said groove orientates said one of said walls of said first room parallel to said adjoining wall of said second room, and inner groove guide wall being inaccessible from either side of said wall.

2. The modular wall structure as set forth in claim 1, wherein said inner groove guide wall includes an angled guide wall and a straight guide wall being adjacent to said channel, said angled guide wall being a guide as said tongue is being inserted.

3. The modular wall structure as set forth in claim 1, further including a second groove extending from a second wall of said first room and a second tongue extending from a first side wall of a third room, wherein said second tongue being located within said second groove and said second wall of said first room being parallel to said first side wall of said third room.

4. The modular wall structure as set forth in claim 1, wherein the walls are constructed of steel plate, whereby said plurality of rooms define modular prison cells.

5. The modular wall structure as set forth in claim 1, wherein said tongue and groove are positioned on walls forming a corner.

6. The modular wall structure as set forth in claim 1, wherein said tongue and groove are positioned on co-linear walls.

7. A modular secure wall structure defining a plurality of rooms, each room having a front wall, a rear wall, and a pair of side walls, where some of said walls may be shared between rooms, said wall structure comprising:

at least two of said walls are joined in abutting relation, with the walls being formed by steel plates;

a first tongue extending from one of said steel plate walls of a first room, said first tongue being formed by a steel strip attached to an inner surface of said steel plate wall and extending beyond a length thereof; and a first groove extending from an adjoining steel plate wall of a second room, said first groove being defined by an inner groove guide wall being spaced from said second steel plate wall;

a second groove extending from a second wall of said first room and a second tongue extending from a first side wall of a third room, wherein said second tongue being located within said second groove and said second wall of said first room being parallel to said first side wall of said third room, said first tongue being slidably insertable in said first groove whereby insertion of said first tongue into said first groove orientates said one of said walls of said first room parallel to said adjoining wall of said second room, and inner groove guide wall being inaccessible from either side of said wall.

* * * * *